US011850501B2

(12) United States Patent
Campbell et al.

(10) Patent No.: US 11,850,501 B2
(45) **Date of Patent: *Dec. 26, 2023**

(54) PROTECTIVE APPARATUS WITH GROOVES

(71) Applicant: Under Armour, Inc., Baltimore, MD (US)

(72) Inventors: Derek Campbell, Baltimore, MD (US); Jedd Komlos, Baltimore, MD (US); Tim Connelly, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 554 days.

This patent is subject to a terminal disclaimer.

(21) Appl. No.: 16/881,097

(22) Filed: May 22, 2020

(65) Prior Publication Data

US 2020/0282288 A1 Sep. 10, 2020

Related U.S. Application Data

(63) Continuation of application No. 15/287,975, filed on Oct. 7, 2016, now Pat. No. 10,695,650.

(60) Provisional application No. 62/238,839, filed on Oct. 8, 2015, provisional application No. 62/238,319, filed on Oct. 7, 2015.

(51) Int. Cl.

| | |
|---|---|
| ***A63B 71/12*** | (2006.01) |
| ***A63B 71/10*** | (2006.01) |
| ***A63B 71/14*** | (2006.01) |
| ***A42B 1/08*** | (2006.01) |
| ***A41D 13/00*** | (2006.01) |
| ***A42B 3/00*** | (2006.01) |
| ***A42B 3/20*** | (2006.01) |
| ***A41D 13/015*** | (2006.01) |

(52) U.S. Cl.

CPC ..... *A63B 71/1225* (2013.01); *A41D 13/00* (2013.01); *A42B 1/08* (2013.01); *A42B 3/00* (2013.01); *A42B 3/205* (2013.01); *A63B 71/10* (2013.01); *A63B 71/12* (2013.01); *A63B 71/14* (2013.01); *A41D 13/0156* (2013.01); *A63B 71/141* (2013.01); *A63B 2071/1258* (2013.01)

(58) Field of Classification Search

CPC .. A41D 13/0156; A41D 13/0158; A42B 3/08; A42B 3/205

See application file for complete search history.

(56) References Cited

U.S. PATENT DOCUMENTS 4,272,850 A 6/1981 Rule
5,168,576 A 12/1992 Krent et al.
(Continued)

FOREIGN PATENT DOCUMENTS

WO 2013116157 A1 8/2013

*Primary Examiner* — F Griffin Hall
(74) *Attorney, Agent, or Firm* — Edell, Shapiro & Finnan, LLC

(57) ABSTRACT

A sports accessory is provided to be worn by a user during a sport activity. The accessory includes a flexure system. The flexure system includes a support structure including a plurality of intersecting grooves disposed along a surface of the support structure, where a plurality of segments are defined along the surface of the support structure between the intersecting grooves such that the support structure is configured to flex along the grooves with segments moving in relation to other segments during use of the sports accessory.

17 Claims, 17 Drawing Sheets

(56) References Cited

U.S. PATENT DOCUMENTS 5,360,653 A 11/1994 Ackley
D353,228 S 12/1994 Henson
5,416,924 A 5/1995 Sims
5,477,558 A 12/1995 Volker et al.
6,093,468 A * 7/2000 Toms ..... A41D 13/0158 2/22
6,553,994 B2 4/2003 Bard
6,654,960 B2 12/2003 Cho
6,969,548 B1 11/2005 Goldfine
D582,608 S 12/2008 Palmer
7,735,160 B1 * 6/2010 Schiebl ..... A42B 3/08 2/425
7,861,318 B2 1/2011 Grillot et al.
7,886,370 B2 * 2/2011 Winningham ..... A63B 71/10 2/9
7,921,475 B2 * 4/2011 Nascimento ..... A42B 3/08 2/424
8,220,072 B2 7/2012 Dodd
D693,064 S 11/2013 Dupree et al.
8,621,671 B1 * 1/2014 Schiebl ..... A42B 3/205 2/421
8,627,512 B2 1/2014 Dodd
8,661,564 B2 3/2014 Dodd
RE44,851 E 4/2014 Taylor
8,961,733 B2 2/2015 Dodd
9,345,281 B1 * 5/2016 Schiebl ..... A42B 3/205
10,695,650 B2 * 6/2020 Campbell ..... A41D 13/0156
2011/0113559 A1 5/2011 Dodd
2012/0240317 A1 9/2012 Diamond
2012/0291188 A1 * 11/2012 Grosstesner ..... A41D 13/0156 2/22
2013/0025035 A1 1/2013 Turner
2013/0025036 A1 1/2013 Turner
2013/0025037 A1 1/2013 Turner
2013/0232674 A1 9/2013 Behrend et al.
2013/0234376 A1 9/2013 Frey
2013/0283511 A1 10/2013 Diamond
2014/0068844 A1 * 3/2014 Infusino ..... A42B 3/08 2/421
2014/0150170 A1 6/2014 Kim
2014/0157631 A1 6/2014 Dodd
2014/0259324 A1 9/2014 Behrend et al.
2014/0259325 A1 9/2014 Behrend et al.
2014/0298558 A1 10/2014 Dodd
2014/0298573 A1 10/2014 Turner et al.
2015/0335079 A1 11/2015 Lacey et al.

* cited by examiner

PROTECTIVE APPARATUS WITH GROOVES

CROSS-REFERENCE TO RELATED APPLICATIONS

This application is a continuation of U.S. application Ser. No. 15/287,975, filed on Oct. 7, 2016, entitled "Protective Apparatus with Grooves," which claims priority under 35 U.S.C. 119(e) to U.S. Provisional Patent Application Ser. No. 62/238,319, entitled "Protective Apparatus with Grooves", filed Oct. 7, 2015, and to U.S. Provisional Patent Application Ser. No. 62/238,839, entitled "Protective Apparatus with Grooves", filed Oct. 8, 2015, the disclosures of which are incorporated herein by reference in their entirety for all purposes.

FIELD OF THE INVENTION

The present invention relates to an apparatus that protects bodily parts of an athlete. More specifically, the present invention relates to wearable apparatuses that provide impact protection for bodily parts while remaining flexible to bend and conform to the bodily parts.

BACKGROUND OF THE INVENTION

Protective apparatuses are used by athletes in various situations. Soccer players use shin guards. Catchers use helmets, chest protectors, and leg guards. Baseball batters often wear leg guards and arm guards while they bat. Football players use helmets, chinstraps, shoulder pads, and leg pads.

Currently available protective apparatuses are often bulky, heavy, and are not shaped to the specific human anatomy that they are designed to protect. It is often difficult to move freely when wearing bulky and heavy protective apparatuses. Currently available protective apparatuses are also uncomfortable for athletes to wear during athletic maneuvers and movements. The bulkiness of the protective apparatuses may restrict the freedom of movement, while the heaviness may restrict the speed at which the athletes can make the necessary movements. The bulkiness further adds to the stiffness of the protective apparatuses, making them less likely to bend and flex to conform to the body part they are protecting, especially when the body parts are moving. Thus, while proper protection may be accomplished by currently known protective apparatuses, they restrict movement of the athlete and impact the athlete's performance.

Therefore, what is needed is a protective apparatus that can be worn by athletes where the protective apparatus provides proper protection of body parts, but does not limit the freedom of movement of the athlete while being worn. Moreover, what is needed is a protective apparatus that is configured to flex, bend, and/or conform to the athlete's anatomy as the athlete moves, making the protective apparatus comfortable to wear while still providing freedom of movement and proper protection.

SUMMARY OF THE INVENTION

A sports accessory to be worn by a user during a sport activity includes a flexure system, where the flexure system comprises a support structure including a plurality of intersecting grooves disposed along a surface of the support structure. The plurality of segments are defined along the surface of the support structure between the intersecting grooves such that the support structure is configured to flex along the grooves with segments moving in relation to other segments during use of the sports accessory.

The above and still further features and advantages of the present invention will become apparent upon consideration of the following detailed description of specific embodiments thereof.

BRIEF DESCRIPTION OF THE DRAWINGS

Like reference numerals have been used to identify like elements throughout this disclosure.

DETAILED DESCRIPTION OF THE INVENTION

In accordance with the present invention, a sports accessory to be worn during sporting activity includes a flexure system for improved fit. The flexure system includes a support structure including a plurality of segments separated by intersecting grooves. Each segment possesses a geometry adapted to interact with adjacent segments. In an embodiment, the accessory includes a resilient shell incorporating the flexure system. The system is configured to permit flexure in a first direction but inhibit or prevent flexure in a second direction beyond a predetermined curvature value. In another embodiment, the accessory includes a compressible material incorporating the flexure system. The system is configured move from a spread configuration to a collapsed configuration. In the collapsed configuration, contact forces are dissipated along a wider area.

Figure 1:
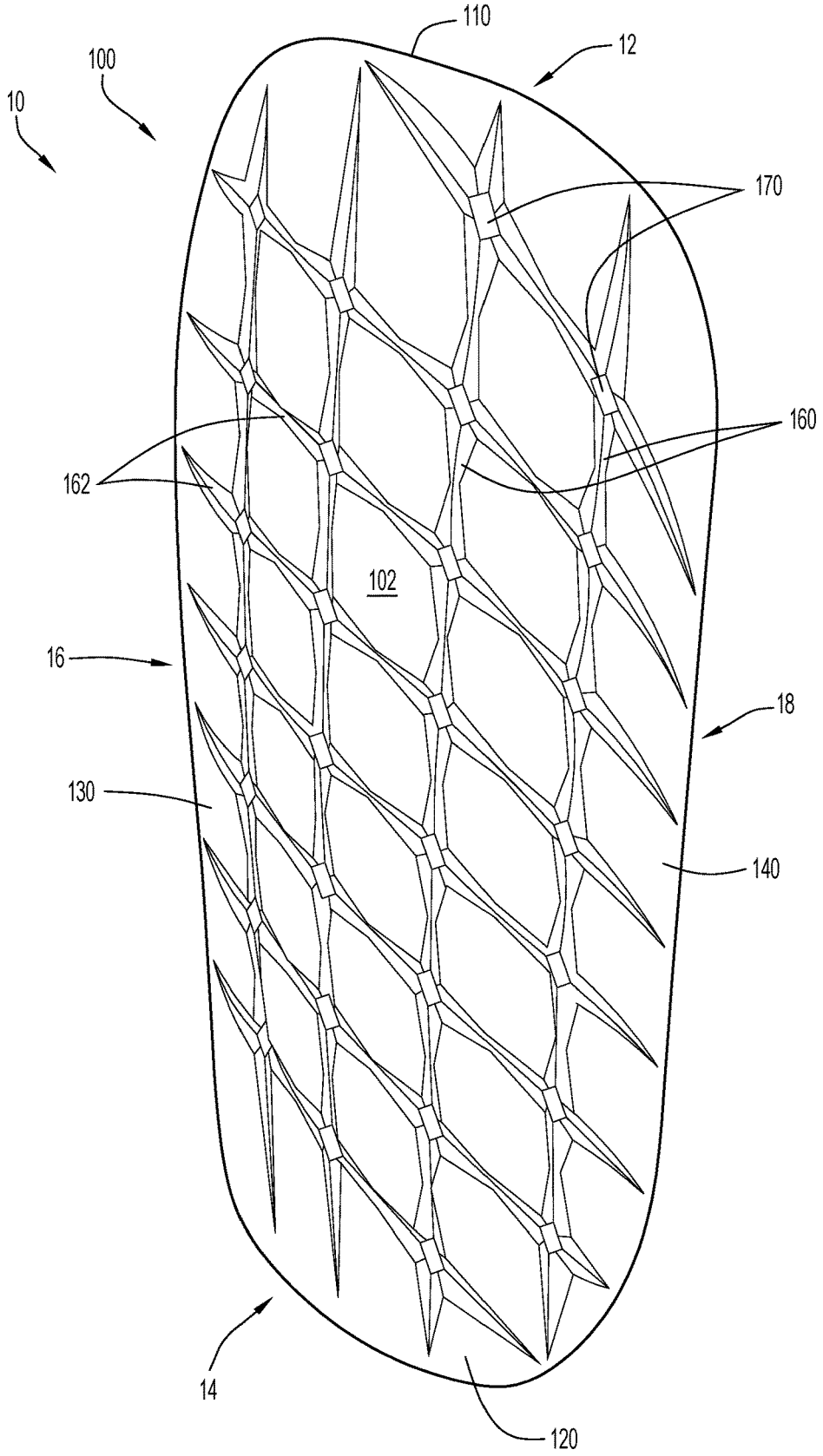
FIG. 1 illustrates a front view of an embodiment of a shin guard according to the present invention.
Figure 2:
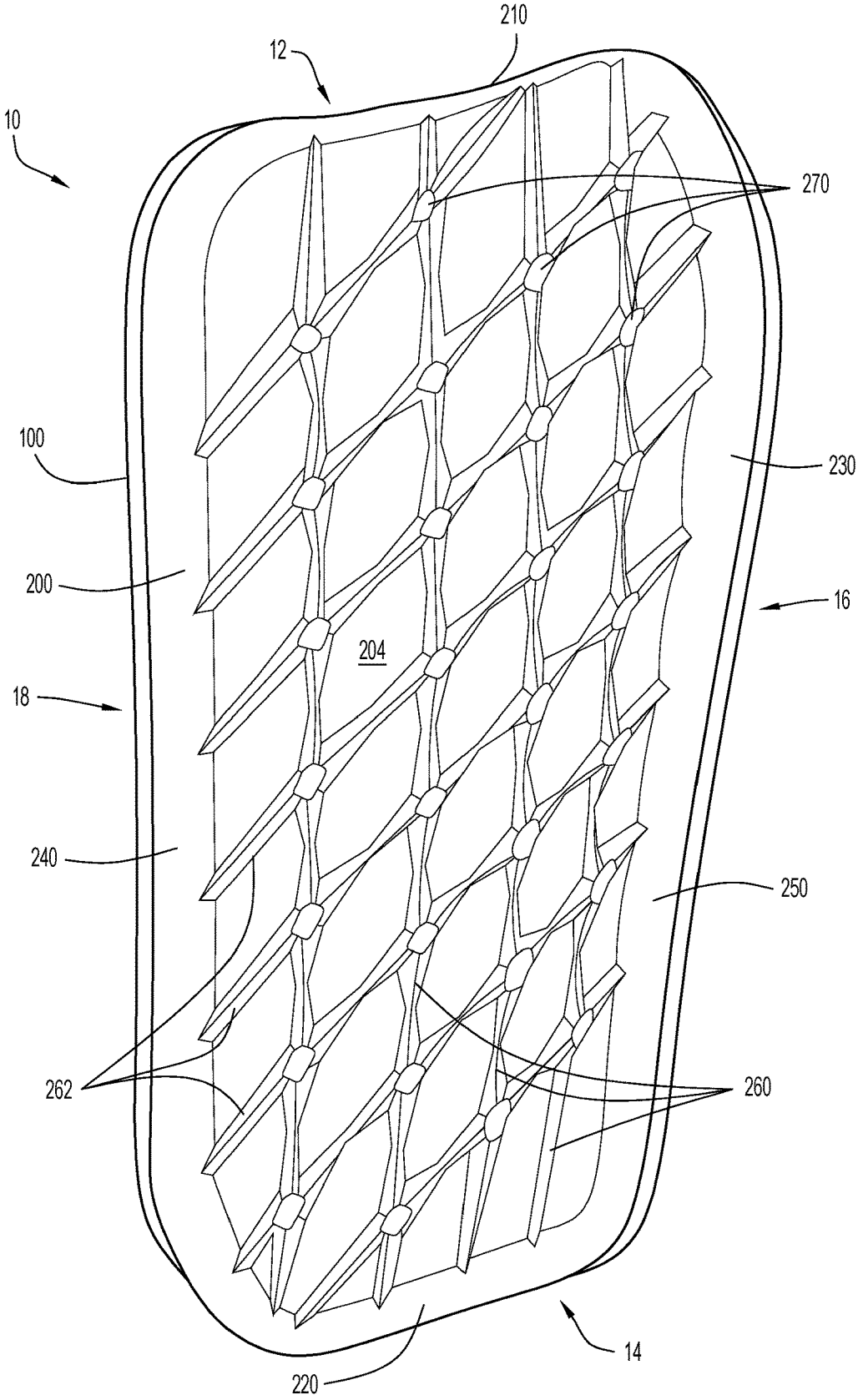
FIG. 2 illustrates a rear view of the embodiment of the shin guard illustrated in FIG. 1.

In an example embodiment, a shin guard 10 including a flexure system of the present invention is described herein with reference to FIGS. 1-5. As illustrated in FIGS. 1 and 2, the shin guard 10 defines a top 12, a bottom 14, a first or lateral side 16, and a second medial side 18. The shin guard 10 includes a generally rigid plate 100 or shell and a backing member 200 or liner formed of compressible material such as an elastomeric polymer (e.g., EVA foam). The plate 100 of the shin guard may be constructed from thermoplastic polymers, such as polypropylene. As illustrated in FIG. 1, the plate 100 of the shin guard 10 defines an outer surface 102 and an inner or user-facing surface 104 (illustrated in FIG. 6A). The plate 100 of the shin guard 10 has a top side 110, a bottom side 120 opposite the top side 110, a first side 130, and a second side 140 opposite the first side 130. The first and second sides 130, 140 span the distance between the top side 110 and the bottom side 120. Further illustrated in FIG. 1 is a plurality of grooves 160, 162 and apertures 170 extending from plate outer surface 102 to the plate inner surface 104.

As illustrated in FIG. 2, the backing member 200 of the shin guard 10 has front surface 202 (illustrated in FIG. 3) and a rear surface 204. The backing member 200 of the shin guard 10 has a top side 210, a bottom side 220 opposite the top side 210, a first side 230, and a second side 240 opposite the first side 230. Similar to the plate 100, the first and second sides 230, 240 of the backing member 200 span the distance between the top side 210 and the bottom side 220. Furthermore, the backing member 200 contains an outer edge 250 that spans around the perimeter defined by the top, bottom, first, and second sides 210, 220, 230, 240. Further illustrated in FIG. 2 is a plurality of grooves 260, 262 and apertures 270 disposed within the rear surface 204 of the backing member 200.

Figure 3:
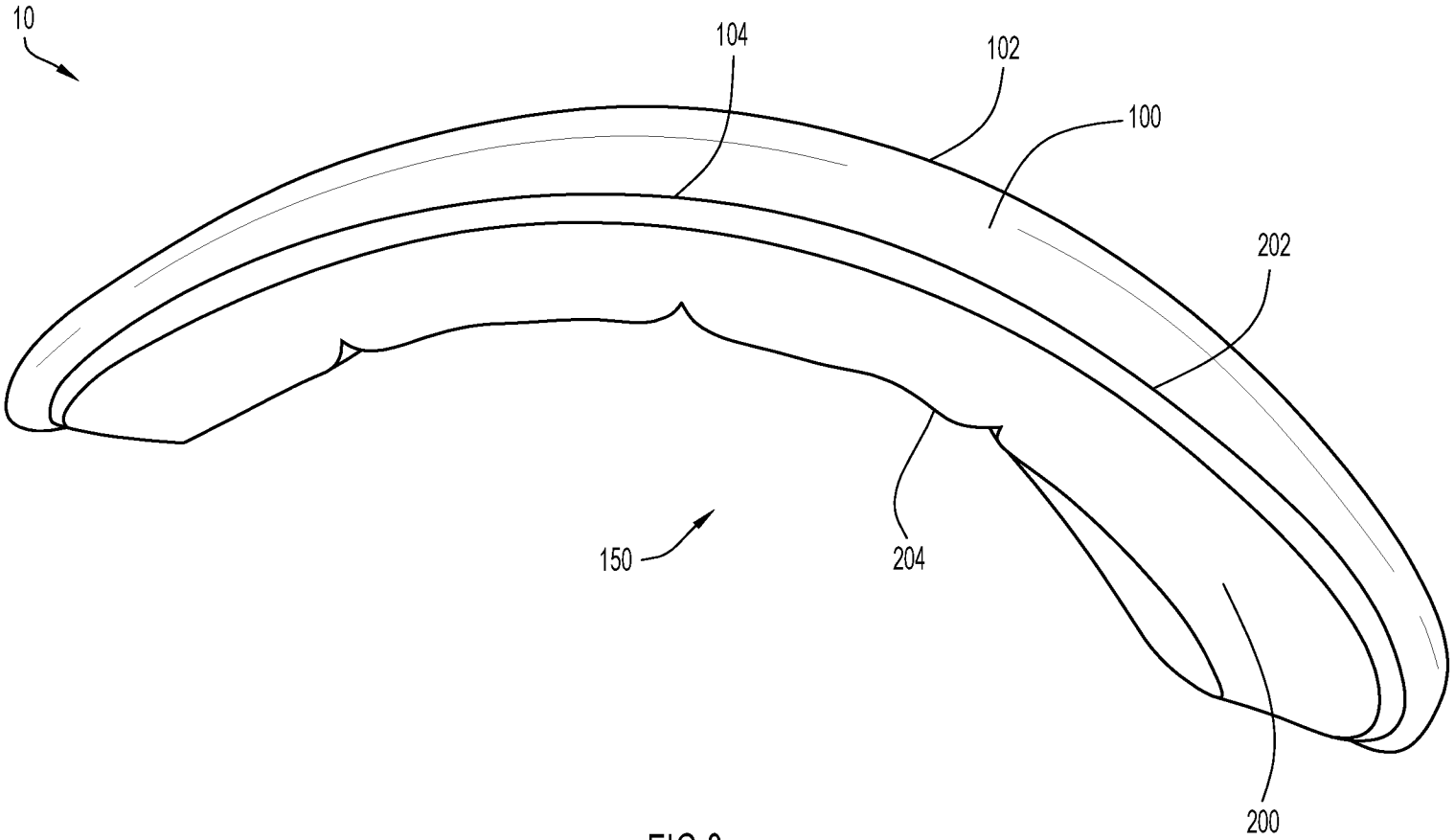
FIG. 3 illustrates a top view of the embodiment of the shin guard illustrated in FIG. 1.

Turning to FIG. 3, the backing member 200 is coupled to the plate 100. Moreover, the front side 202 of the backing member 200 is coupled to the inner surface 104 of the plate 100. Thus, the outer surface 102 of the plate 100 and the rear surface 204 of the backing member 200 are exposed. The backing member 200 may be adhered to the plate 100 by any conventional means, such as glue, cement, co-molding, etc. As best illustrated in FIG. 3, the plate 100 and the backing member 200 possess a curvature 150. The curvature 150 enables the shin guard 10 to wrap comfortably around the shin of a wearer of the shin guard 10. The curvature 150 of the shin guard 10 orients the backing member 200 along the inner side of shin guard 10 so, when the shin guard 10 is placed around the shin of a wearer, the backing member 200 is placed against the surface of the shin.

Figure 4:
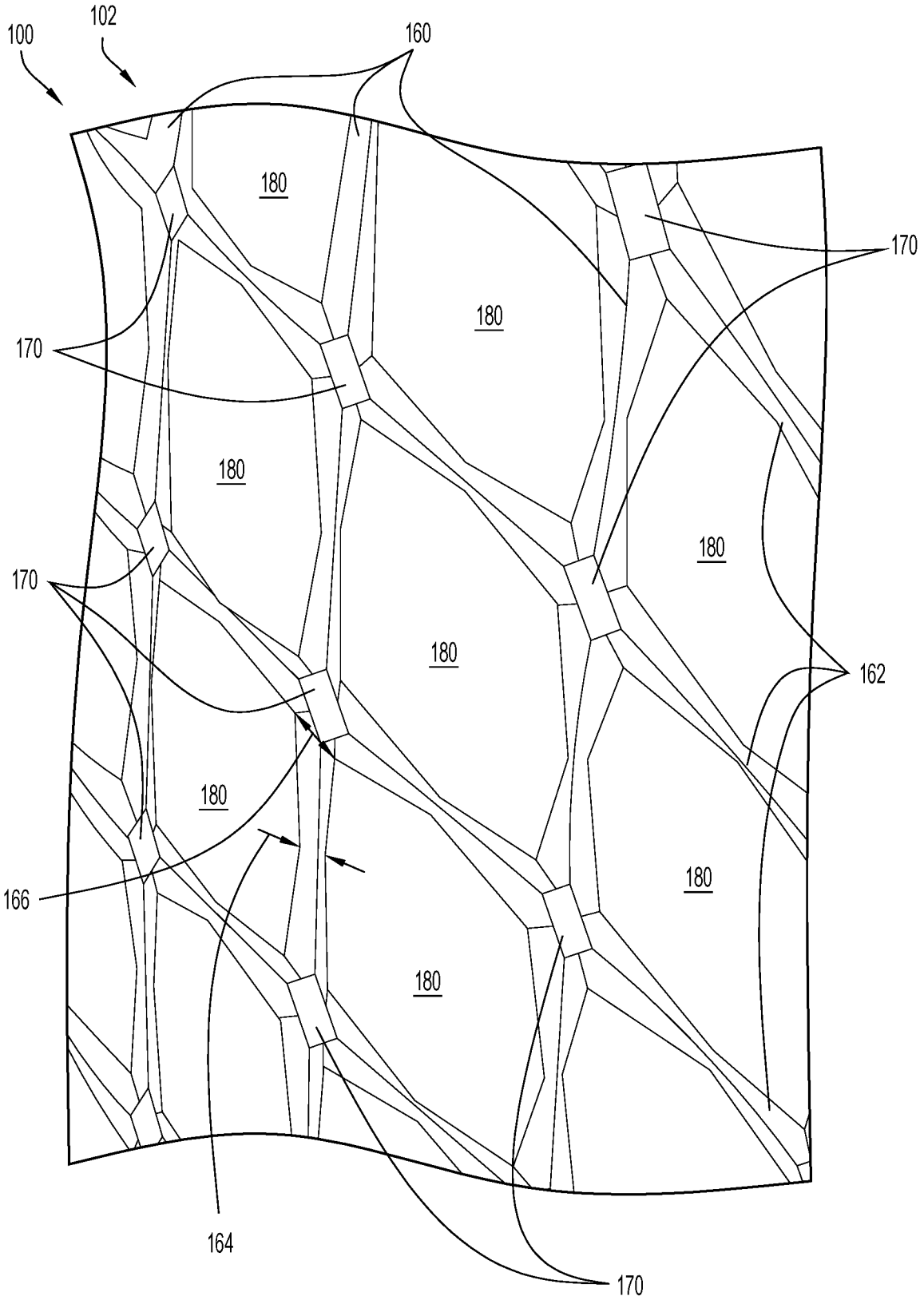
FIG. 4 illustrates a front view of the plate of the embodiment of the shin guard illustrated in FIG. 1.

Disposed within the outer surface 102 of the plate 100 is a flexure system comprising two sets of grooves 160, 162, and a series of apertures 170. As described herein for each of the embodiments, the grooves of the flexure system (e.g., grooves 160, 162 for the shin guard 10) define lines of flexure for portions or segments of a hard plate or structure of the apparatus. Referring to FIGS. 1 and 4, a first set of grooves 160 extends along a first dimension of the plate (e.g., the grooves extend substantially along the length of the plate 100 between the top side 110 and the bottom side 120). As best illustrated in FIG. 1, the first set of grooves 160 may be oriented such that it extends from the top side 110 to the bottom side 120 of the plate 100 at an angle offset from a vertical axis. A second set of grooves 162 extend along a second dimension of the plate (e.g., the grooves extend substantially along the width of the plate 100, between the first side 130 and the second side 140). The second set of grooves 162 may be oriented such that the grooves extend from the first side 130 to the second side 140 of the plate 100 at an angle offset from a horizontal axis. With this configuration, the first set of grooves 160 intersect the second set of grooves 162 to form a grid or array of plate sections or plate segments 180. The sections 180, defined by the grooves 160, 162, may have a substantially rhomboidal or parallelogram shape. Moreover, located at the intersection of each of the grooves 160, 162 are apertures 170.

As best illustrated in FIG. 4, the first and second sets of grooves 160, 162 are formed as depressions in the outer surface 102 of the plate 100. The grooves 160, 162 may be formed on the front surface 102 of the plate 100 by any suitable process including, without limitation, etching, engraving, carving, impressing, scoring, incising, stamping, defined during formation of the component (e.g., formed in a molding process), etc. Thus, the thickness of the plate 100 at the grooves 160, 162 may be smaller than the thickness of the plate 100 at the plate sections 180. Further illustrated in FIG. 4, the grooves 160, 162 vary in width along the length of the grooves 160. Both the first and second sets of grooves 160, 162 may have a first, or minimum, width 164 and a second, or maximum, width 166. The first width 164 is smaller than the second width 166. The grooves 160, 162 have the second, or maximum, width 164 at points of the grooves 160, 162 that are proximate to the apertures 170. In addition, the grooves 160, 162 have the first, or minimum, width 164 at points of the grooves 160, 162 that are furthest from any aperture 170. Thus, as illustrated in FIG. 4, the grooves 160, 162 will have a first width 164 at locations that are equidistant between two apertures 170. Moreover, FIG. 4 further illustrates that the width of the grooves 160, 162 may gradually increase and decrease between the first width 164 and the second width 166. Additionally, both sets of grooves 160, 162 may repeatedly alternate between the first width 164 and the second width 166 along the length of a groove 160, 162.

The combination of the grooves 160, 162 and the apertures 170 enable the plate 100 to have a degree of flexure. The grooves 160, 162 define the lines of flexure of the plate 100. Moreover, the plate 100 is capable of flexing along each of the grooves 160, 162, enabling each of the plate sections 180 to move a varying degree in relation to other plate sections of the plate. Thus, the grooves 160, 162 define lines of flexure along the plate 100 of the shin guard 10 such that the plate is configured to flex, bend, and/or conform to the shape and/or curvature of the shin of the wearer of the shin guard 10. The grooves 160 and the apertures 170 enable the plate 100 to conform to the shin of a wearer while providing the proper and maximum amount of impact protection without sacrificing comfort to the wearer of the shin guard 10.

Additionally, the varying widths 164, 166 of the grooves 160, 162, as previously described herein, define sides having beveled edges for the plate sections 180. In particular, the varying widths 164, 166 of the grooves 160, 162 define beveled edges along the sides of each plate section 180, where each side of a plate section 180 has a generally convex shape that corresponds with a generally convex side of an adjacent or neighboring plate section 180 (where the corresponding sides of the adjacent or neighboring plate sections 180 are defined within the same groove 160, 162). The corresponding sides of adjacent or neighboring plate sections 180, each having generally convex sides with beveled edges, create areas of interference between the edges of the plate sections 180 that permit flexure of the plate 100 in one direction (e.g., in a direction in which adjacent or neighboring plate sections 180 are pivoted away from each other along their corresponding groove 160, 162), but prevent flexure of the plate 100 beyond a certain degree in the opposite direction (e.g., in a direction in which adjacent or neighboring plate sections 180 are pivoted toward each other along their corresponding groove 160, 162).

With the grooves 160, 162 being disposed on the outer surface 102 of the plate 100 in the manner and configuration as described herein, the grooves 160, 162 permit the plate 100 to flex and/or bend inwardly so that the sides 110, 120,130, 140 are moved closer to one another. For example, the plate 100 may be flexed inwardly about the curvature 150 such that the sides 130, 140 of the plate 100 are moved closer to one another. The grooves 160, 162 may impart enough flexure to the plate 100 that the plate 100 may be flexed or bent inwardly until the sides 110, 120, 130, 140 contact one another. Conversely, the minimum width 164 of the grooves 160, 162 and resultant beveled edges of the plate sections 180 (which causes interference between facing sides of adjacent or neighboring plate sections) prevents the plate 100 from flexing or bending in the opposite, or outward, direction beyond a certain degree. As the plate 100 is flexed outwardly, such that the sides 110, 120, 130, 140 are move away from each other and the curvature 150 in the plate 100 is reduced, the beveled edges of the plate sections 180 proximate to the minimum widths 164 of the grooves 160, 162 come into contact with one another so as to interfere with or impinge upon further flexing of the plate sections 180 in this direction. Once the edges of the plate sections 180 contact one another, additional outward flexure of the plate 100 is reduced or completely prevented. The minimum widths 164 may be sized so that the edges of the plate sections 180 contact one another when the plate 100 no longer has a curvature 150 and is substantially flat. Reducing the size of the minimum widths 164 decreases the degree of flexure of the plate 100 in the outward direction, while increasing the minimum widths 164 increases the degree of flexure of the plate 100 in the outward direction.

Furthermore, as best illustrated in FIG. 1, the distance between the first set of grooves 160 is larger proximate the top 110 of the plate 100 than the distance between the first set of grooves 160 proximate to the bottom 120 of the plate 100. This in turn results in at least some plate sections 180 at or near the top 110 of the plate 100 that are larger in size (i.e., greater surface area of the plate section along the plate outer surface 102) in relation to plate sections 180 at or near the bottom 120 of the plate 100. The distance between the first set of grooves 160 tapers from top to bottom, which aides in the shin guard 10 conforming to the shin of a wearer of the shin guard 10 because the leg narrows from the top of the leg to the bottom of the leg. The distance between the first set of grooves 160 proximate to the top 110 of the plate 100 may be approximately one inch or greater, while the distance between the first set of grooves 160 proximate to the bottom 120 of the plate 100 may be approximately half an inch or smaller. In another embodiment, the distance between second set of grooves 162 may taper from one side to another side of the plate 100.

Figure 5:
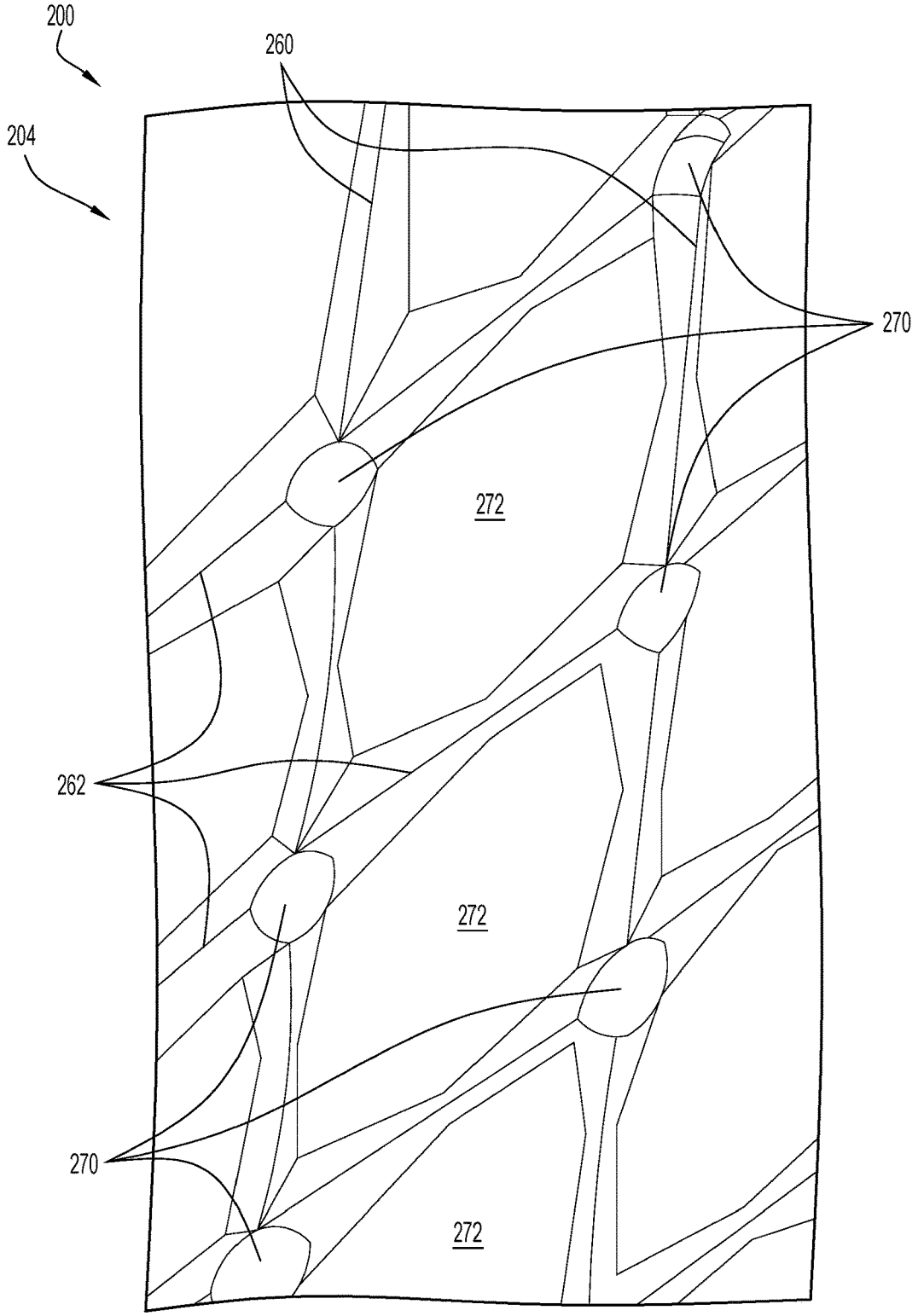
FIG. 5 illustrates a rear view of the cushion of the embodiment of the shin guard illustrated in FIG. 1.

Turning to FIG. 5, the rear surface 204 of the backing member 200 includes two sets of channels 260, 262 and a series of apertures 270. As best illustrated in FIGS. 2 and 5, the first set of grooves 260 are disposed to extend substantially along the length direction of the backing member 200, between the top surface 210 and the bottom surface 220 of the backing member 200. However, the first set of grooves 260 may be disposed in the backing member 200 such that the first set of grooves 260 extend from the top side 210 to the bottom side 220 at an angle offset from a vertical axis. Moreover, the second set of grooves 262 are disposed in the backing member 200 such that the second set of grooves 262 extend substantially along the width direction of the backing member 200, from the first side 130 to the second side 140. The second set of channels 262 may extend from the first side 230 to the second side 240 of the backing member 200 at an angle offset from a horizontal axis.

Similar to the plate grooves 160, 162, the first set of channels 260 and the second set of channels 262 intersect each other to form a grid-like or lattice-like appearance on the rear surface 204 of the backing member 200. The grid-like appearance of the channels 260, 262 creates individual pad sections 272 that are defined by the channels 260, 262. Because of the orientation of the first and second sets of channels 260, 262 in the backing member 200, the pad sections 272 may have a substantially rhomboidal or parallelogram shape. Thus, the pad sections 272 are substantially similar in shape to the plate sections 180 that are disposed on the plate 180. Moreover, located at the intersection of the first set of channels 260 and the second set of channels 262 are apertures 270.

The first set of channels 260, second set of channels 262, apertures 270, and pad sections 272 are disposed along the rear surface 204 of the backing member 200 so that they align with the first set of grooves 160, second set of grooves 262, apertures 170, and plate sections 180, respectively. Thus, the first set of channels 260 that extend substantially along the length of the backing member 200 are aligned with the first set of grooves 160 that extend substantially along the length of the plate 100. Similarly, the second set of channels 262 that extend substantially along the length of the backing member 200 is aligned with the second set of grooves 162 that extend substantially along the length of the plate 100. Because the first and second set of channels 260, 262 are aligned with the first and second set of grooves 160, 162, it then follows that the apertures 270 are aligned with the apertures 170, and the pad sections 272 of the backing member 200 are of equivalent shape and size to the plate sections 180 of the plate 100.

By aligning the first set of channels 260, second set of channels 262, apertures 270, and pad sections 272 with the first set of grooves 160, second set of grooves 262, apertures 170, and plate sections 180, respectively, the backing member 200 provides additional features beyond cushioning. Firstly, the alignment of the channels 260, 262 with the grooves 160, 162 enables the backing member 200 to flex in the same manner and to a similar degree as the plate 100. With the backing member 200 being constructed from a substantially compressible material and being configured to flex, bend, and/or conform to the shape of the shin of the wearer of the shin guard 10, the shin guard 10 is able to provide protection for the shin while also being comfortable to the wearer. While the backing member 200, because it is constructed from a compressible material, would still be able to flex and bend with the plate 100 if the backing member 200 did not contain the channels 260, 262, the channels 260, 262 prevent the backing member 200 from bending and folding onto itself.

In addition, because the apertures 170 on the plate 100 are aligned with the apertures 270 of the backing member 200, the combination of the apertures 170, 270 enables air to flow through the shin guard 10 to the shin covered by the shin guard 10. Providing airflow through the shin guard 10 enables for the shin of the wearer of the shin guard 10 to maintain a cooler temperature when the shin guard 10 is in use, making the shin guard 10 more comfortable to wear. The configuration of the channels 260, 262 being connected with the apertures 270 enables air that flows into the apertures 170 to flow along the channels 260, 262 throughout the surface area covered by the shin guard 10. Furthermore, because the channels 260, 262 are at angles offset from horizontal and vertical axes, the channels 260, 262 are capable of collecting sweat from the shin of the wearer and diverting the collected sweat out of the area that is covered by the shin guard 10.

Figure 6A:
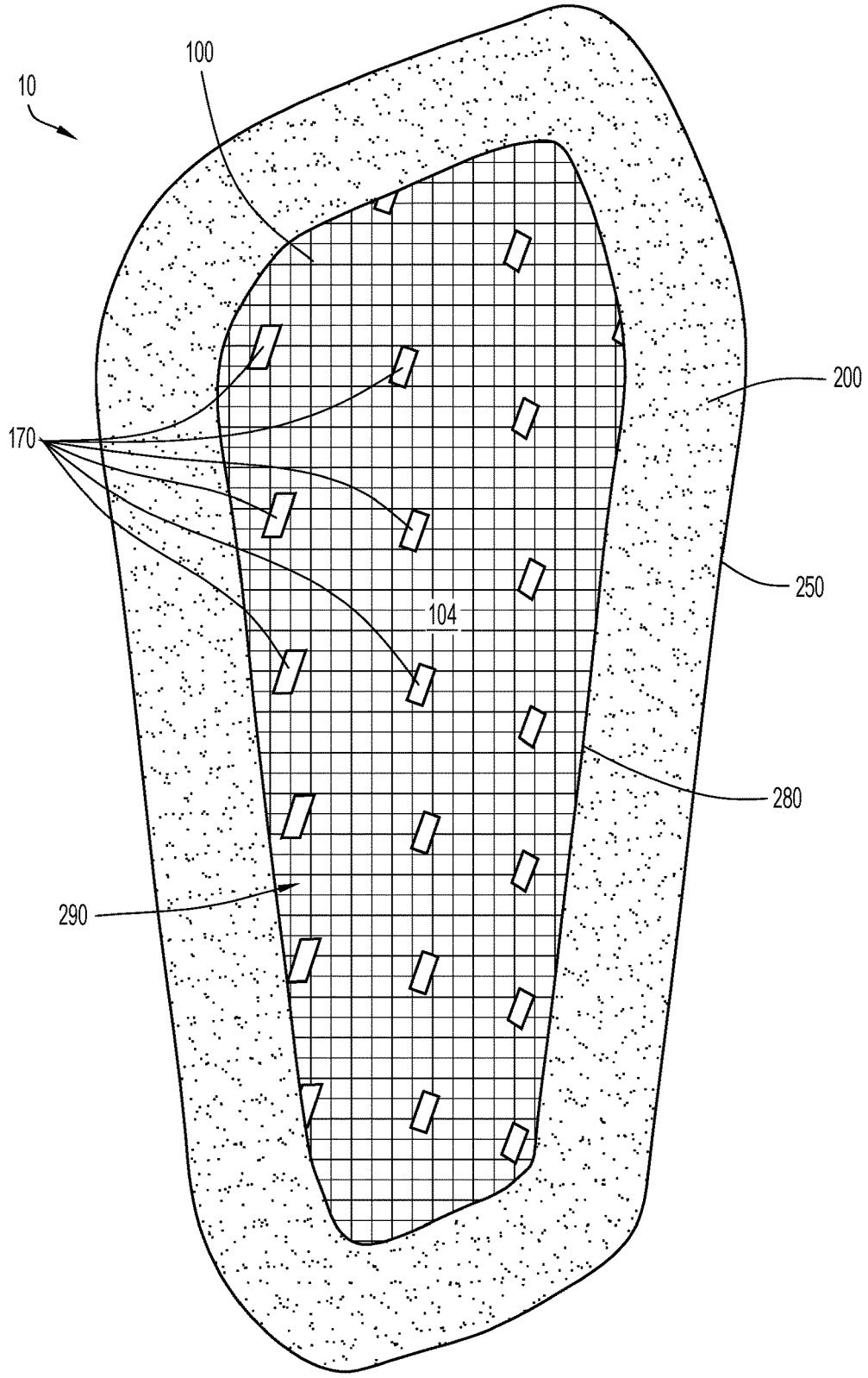
FIG. 6A illustrates a rear view of another embodiment of a shin guard according to the present invention.

Turning to FIG. 6A, illustrated is a second embodiment of the backing member 200 of the shin guard 10. The second embodiment of the backing member 200 includes an outer edge 250 and an inner edge 280, where the inner edge 280 defines an opening 290. As illustrated in FIG. 6A, the second embodiment of the backing member 200 is disposed around the perimeter of the plate 100, and the opening 290 exposes the inner surface 104 of the plate 100. Furthermore, the opening 290 also exposes the majority of the apertures 170, which further enables airflow to the shin of the wearer of the shin guard 10. Similar to the previous embodiment, the second embodiment of the backing member 200 may be constructed from a compressible material (e.g., EVA foam).

Figure 6B:
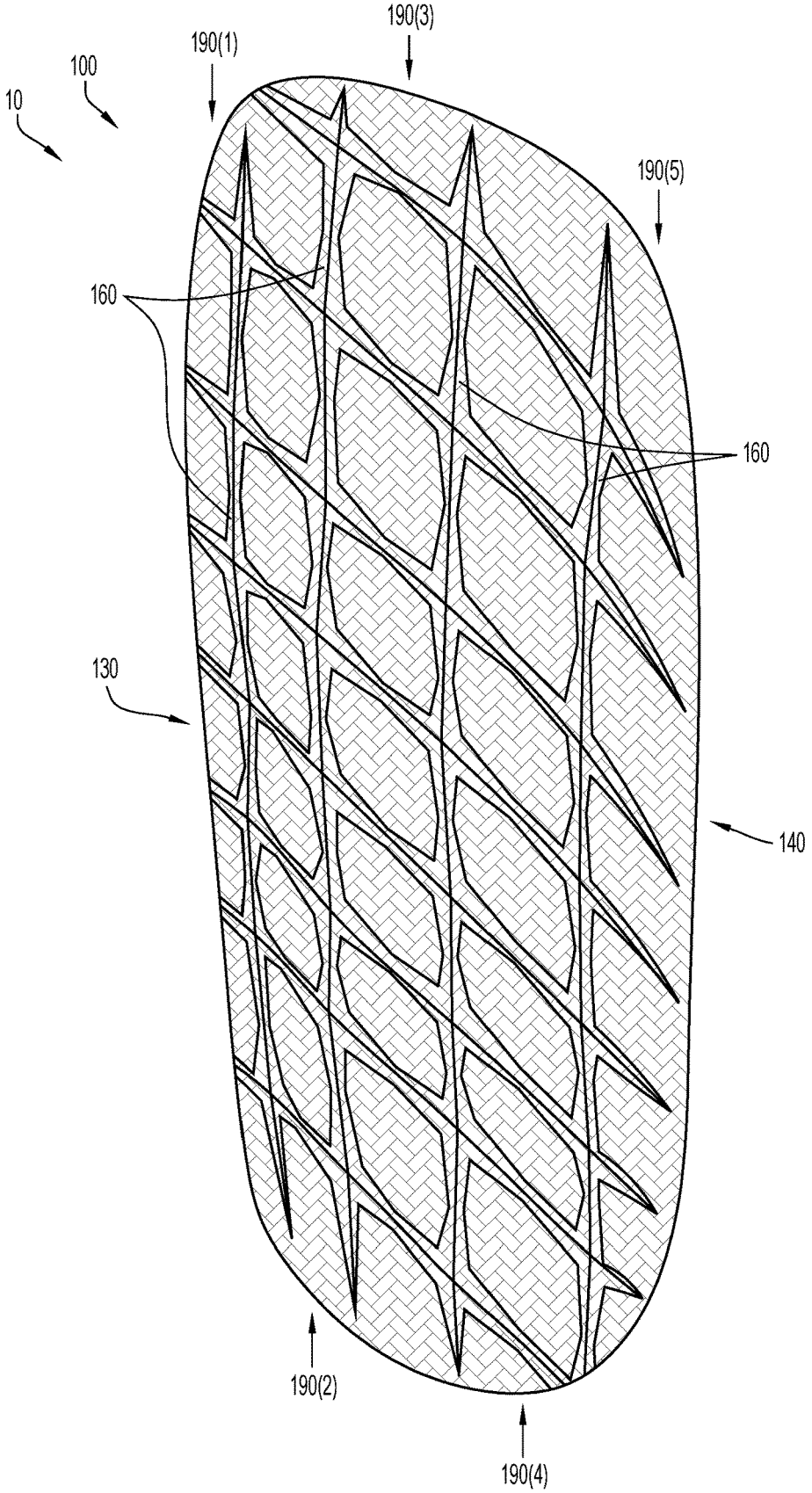
FIG. 6B illustrates a front view of another embodiment of a shin guard according to the present invention.

In yet another embodiment of the shin guard 10, the plate 100 may be constructed from a sheet, or plurality of sheets, of interwoven carbon fibers that are infused with resin to give the carbon fiber sheet rigidity. While interwoven carbon fibers may be the preferred material, other interwoven fibers may be used and infused with resin, such as, but not limited to fiberglass, aramid, etc. The plate 100 may contain vertically orientated regions that are oriented adjacent to one another and span from the first side 130 to the second side 140 of the plate 100. As illustrated in FIG. 6B, the plate 100 may contain five vertical regions 190(1)-190(5) that are defined by the first set of grooves 160 of the plate 100. The first region 190(1) of the plate 100 may be constructed with a first resin, while the adjacent second region 190(2) of the plate 100 may be constructed with a second resin. The first resin, when combined with the carbon fiber sheet at the first region 190(1), provides the first region 190(1) with a first durometer value, while the second resin, when combined with the carbon fiber sheet at the second region 190(2), provides the second region 190(2) with a second durometer value. The first durometer value may be lower than the second durometer value. Thus, first region 190(1) of the plate 100 is softer than the second region 190(2) of the plate 100, and the first region 190(1) of the plate 100 is capable of flexing more than the second region 190(2) of the plate 100. The first resin may be a softer resin that enables the first region 190(1) of the plate 100 to flex more under pressure than the second region 190(2). The second resin may be a harder resin that provides more rigidity to the second region 190(2) when compared with the first region 190(1). The remaining regions 190(3)-190(5) of the plate 100 may be constructed with similar or different resins of that of the first and second regions 190(1), 190(2). For example, the fifth region 190(5) may be constructed with the same resin as the first region 190(1), while the third and fourth regions 190(4) may be constructed with the same resin as the second region 190(2), to make the first and second 130, 140 side of the plate 140 more flexible than the middle of the plate 100. In another example, the third and fifth regions 190(3), 190(5) may be constructed with the same resin as the first region 190(1), while the fourth region 190(4) may be constructed with the same resin as the second region 190(2). This enables the sides 130, 140 of the plate 100, as well as a portion of the middle of the plate 100 to be flexible while retaining some regions as rigid. In addition, more than two different types of resins may be used. For example, five different resins may be used, one for each of the regions 190(1)-190(5), which would give each region a different durometer value and degree of flexibility.

By making one or several of the regions 190(1)-190(5) of the plate 100 flexible enables the shin guard 10 to fit more comfortably around the shin of a wearer. The more rigid regions of the plate 100 combined with the flexible regions of the plate 100 allows the plate 100 to offer the proper amount and maximum amount of impact protection without sacrificing comfort to the wearer of the shin guard 10. By constructing the plate with regions having the softer resin, the plate 100 is capable of bending and conforming to the shape of the shin of a wearer. In addition, constructing the plate 100 with regions using the harder resin allows the plate 100 to provide better protection that the regions constructed with the softer region from the impact of objects (i.e., other shins). More than 2 different types of resin may be used to construct a plate 100 may from Thus the present invention as disclosed herein provides a protective apparatus with a support structure that includes a flexure system that defines intersecting grooves and segments separated by the grooves along a surface of the support structure, where the flexure system is configured to permit flexure of the support structure in a first direction but inhibit or prevent flexure in a second direction beyond a predetermined curvature value. The apparatus may comprise a plate with a front surface and a rear surface, and a cushion or pad with a front surface and a rear surface. The front surface of the pad may be disposed on the rear surface of the plate. Moreover, the plate and the pad may both include at least one curvature that enables the protective apparatus to anatomically fit around a body part of a user of the protective apparatus. Multiple curvatures of the plate and the pad may be required for the apparatus to anatomically fit certain body parts, such as, a chin, an elbow, a knee, etc. The front surface of the plate may further include a series of grooves and apertures. The series of grooves may be both substantially lateral grooves and substantially longitudinal grooves. In other embodiments, the grooves may be offset from lateral and longitudinal axes. The grooves may be disposed on the front surface of the plate by a process of, without limitation, etching, engraving, carving, impressing, scoring, incising, stamping, defined during formation of the component (e.g., formed in a molding process), etc. Furthermore, the apertures may be disposed at the intersection of the grooves. The combination of the grooves, the apertures, and the material that the plate is constructed from enables the plate to be flexed along multiple directions to adapt to the body part of the user on which the apparatus is disposed, or to bend with the body part as that body part moves and shifts. Further, the configuration of the grooves and resultant shapes of the plate sections of the plate can be configured so as to maximize coverage of the plate sections over a substantial outer surface area of the shin guard while enabling and enhancing flexibility of the shin guard during use.

In another embodiment, an apparatus comprising a flexure system including grooves that similar in configuration to that described for the shin guard of FIGS. 1-6B is implemented in a chinstrap. Referring to FIGS. 7-11, a chinstrap 30 includes a flexure system comprising a series of grooves and apertures similar to that of the shin guard 10. The chinstrap 30 includes a first side 32 that extends in a lengthwise direction of the chinstrap, a second side 34 that opposes the first side 32 and also extends in the lengthwise direction of the chinstrap, a third side 36 that extends in a widthwise direction of the chinstrap, and a fourth side 38 that opposes the third side 36 and also extends in the widthwise direction of the chinstrap. The chinstrap 30 includes a cup 300, an inner cushion member 400 (illustrated in FIG. 9), a first strap 500, and a second strap 600, where the first and second straps 500, 600 extend outwardly from the third and fourth sides 36, 38, respectively. Similar to the plate 100 of the shin guard 10, the cup 300 of the chinstrap 30 is formed of a rigid yet lightweight material (e.g., nylon and/or polypropylene), where the cup 300 is configured to absorb and sustain impact forces during use without significant wear and tear to the cup 300. The inner cushion member 400 of the chinstrap 30 may be constructed from a compressible material such as ethylene vinyl acetate (EVA) foam, polyurethane foam, etc. The inner cushion member 400 is configured to directly engage the user's chin, and thus is constructed of a softer and more flexible material in relation to the cup 300. The inner cushion member 400 provides a cushioning effect as well as further absorption of any impact forces applied to the chinstrap 30 when worn by the user.

Figure 8:
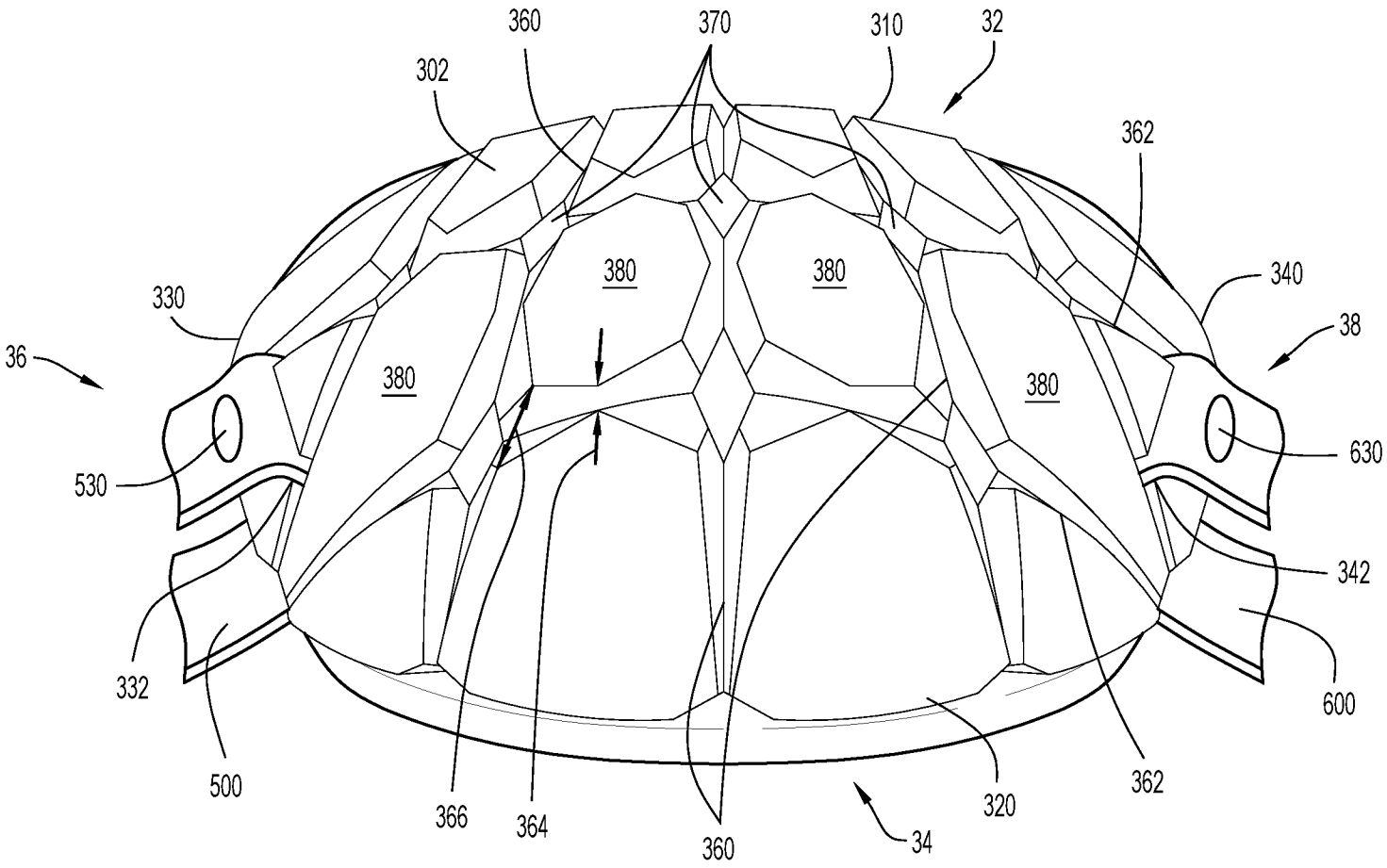
FIG. 8 illustrates a front view of the plate of the embodiment of the chinstrap illustrated in FIG. 7.

Turning to FIG. 8, illustrated is a detailed view of the cup 300 of the chinstrap 30. The cup 300 of the chinstrap 30 includes a front surface 302 and a rear surface 304 (not illustrated). The cup 300 may further include a first side 310, a second side 320, a third side 330, and a fourth side 340, each of which respectively corresponds (i.e., is proximate or in alignment) with the first, second, third and fourth sides 32, 34, 36, 38 of the chinstrap 30. As illustrated, the cup 300 is curved in a convex manner along the front surface 302 of the cup from the first side 310 to the second side 320 about a lateral axis of the cup, and is also curved along the front surface 302 from the third side 330 to the fourth side 340 about a longitudinal axis of the cup. These two curvatures force the cup to form a cavity 306 along the rear surface 304 of the cup (illustrated in FIG. 9). With this configuration, the cavity 306 is shaped and configured to receive the chin of a wearer of the chinstrap 30.

As further illustrated in FIG. 8, the cup 300 includes a first set of grooves 360 disposed in the front surface 302 of the cup 300 in a substantially longitudinal direction where the grooves 360 extend from the first side 310 of the cup 300 to the second side 320 of the cup 300. The cup 300, moreover, includes a second set of grooves 362 disposed in the front surface 302 of the cup 300 in a substantially lateral direction where the grooves 362 extend between the third side 330 and the fourth side 340 of the cup 300. In another embodiment of the chinstrap 30, the first set of grooves 360 may not fully extend from the first side 310 of the cup 300 to the second side 320 of the cup 300, and the second set of grooves 362 may not fully extend from the third side 330 and the fourth side 340 of the cup 300. The sets of grooves 360, 362 may only extend partially across the front surface 302 of the cup 300. In yet another embodiment, the sets of grooves 360, 362 may be offset from the longitudinal and lateral directions. The sets of grooves 360, 362 are configured to intersect one another and form a grid-like or lattice appearance, similar to that described for the shin guard 10. Disposed at the intersection of the first set of grooves 360 with the second set of grooves 362 are apertures 370. Moreover, the grid-like appearance of the grooves 360, 362 define a plurality of cup sections 380 that are generally rectangular.

As further illustrated in FIG. 8, the grooves 360, 362 of the chinstrap 30 may vary in width, similar to that of the grooves 160, 162 of the shin guard 10. The grooves 360, 362 may vary between a first width 364 and a second width 366. The first width 364 may be the minimum, or smallest, width of the grooves 360, 362, while the second width 366 may be the maximum, or largest, width of the grooves 360, 362. The grooves 360, 362 may have the second width 366 at points of the grooves 360, 362 that are proximate to the apertures 370. Furthermore, the grooves 360, 362 may have the first width 364 at points of the grooves 360, 362 that are disposed farthest from the apertures 370. Thus, the grooves 360, 362 may have the first width 364 at a point between, and equidistant from, two apertures 370. The width of grooves 360, 362 may gradually increase or decrease between the first width 364 and the second width 366.

In addition, the grooves 360, 362 may be formed on the outer surface 302 of the cup 300 by any suitable process including, without limitation, etching, engraving, carving, impressing, scoring, incising, stamping, defined during formation of the component (e.g., formed in a molding process), etc. Thus, the grooves 360, 362 are formed as depressions in the outer surface 302 of the cup 300. The cup 300 is thicker at the cup sections 380 than at the grooves 360, 362. By having the cup 300 vary in thickness between the cup sections 380 and the grooves 360, 362, and the grooves 360, 362 being the portions of the cup 300 having the smaller thickness, the cup 300 is configured to have a degree of flexure. The grooves 360, 362 and the apertures 370 define the lines of flexure of the cup 300, where the cup 300 is capable of flexing along each of the grooves 360, 362. The grooves 360, 362 and the apertures enable the cup 300 of the chinstrap 30 to flex, bend, and/or conform to the shape and/or topography of the chin of the wearer of the chinstrap 30 to provide impact protection to the chin and be comfortable to wear.

As similarly described for the shin guard 10, the varying widths of the grooves 360, 362 define sides having beveled edges for the cup sections 380, where each side of a cup section 380 has a generally convex shape that corresponds with a generally convex side of an adjacent or neighboring cup section 380 (where the corresponding sides of the adjacent or neighboring cup sections 180 are defined within the same groove 360, 362). The corresponding sides of adjacent or neighboring cup sections 380, each having generally convex sides with beveled edges, create areas of interference between the edges of the cup sections 380 that permit flexure of the cup 300 in one direction (e.g., in a direction in which adjacent or neighboring cup sections 380 are pivoted away from each other along their corresponding groove 360, 362), but prevent flexure of the cup 300 beyond a certain degree in the opposite direction (e.g., in a direction in which adjacent or neighboring cup sections 380 are pivoted toward each other along their corresponding groove 360, 362). Put another way, the grooves 360, 362 permit the cup 300 to flex and/or bend inwardly, or in the direction that would enclose the cavity 306 of the cup 300. Conversely, the minimum width 364 of the grooves 360, 362 prevents the cup 300 from flexing and/or bending in the opposite, or outward, direction beyond a certain degree. As the cup 300 is flexed outwardly, or in the direction that the cup 300 would no longer form a cavity 306 and would be flat, the edges of the cup sections 380 proximate to the minimum widths 164 of the grooves 360, 362 come into contact with one another. Once the edges of the cup sections 380 contact one another, additional outward flexure of the cup 300 is reduced or completely prevented. Furthermore, reducing the size of the minimum widths 364 decreases the degree of flexure of the cup 300 in the outward direction, while increasing the minimum widths 364 increases the degree of flexure of the cup 300 in the outward direction.

The configuration of the grooves and resultant shapes of the cup sections 380 of the cup 300 can also be configured so as to maximize coverage of the cup sections over a substantial outer surface area of the cup while enabling and enhancing flexibility of the chinstrap 30 during use.

Figure 9:
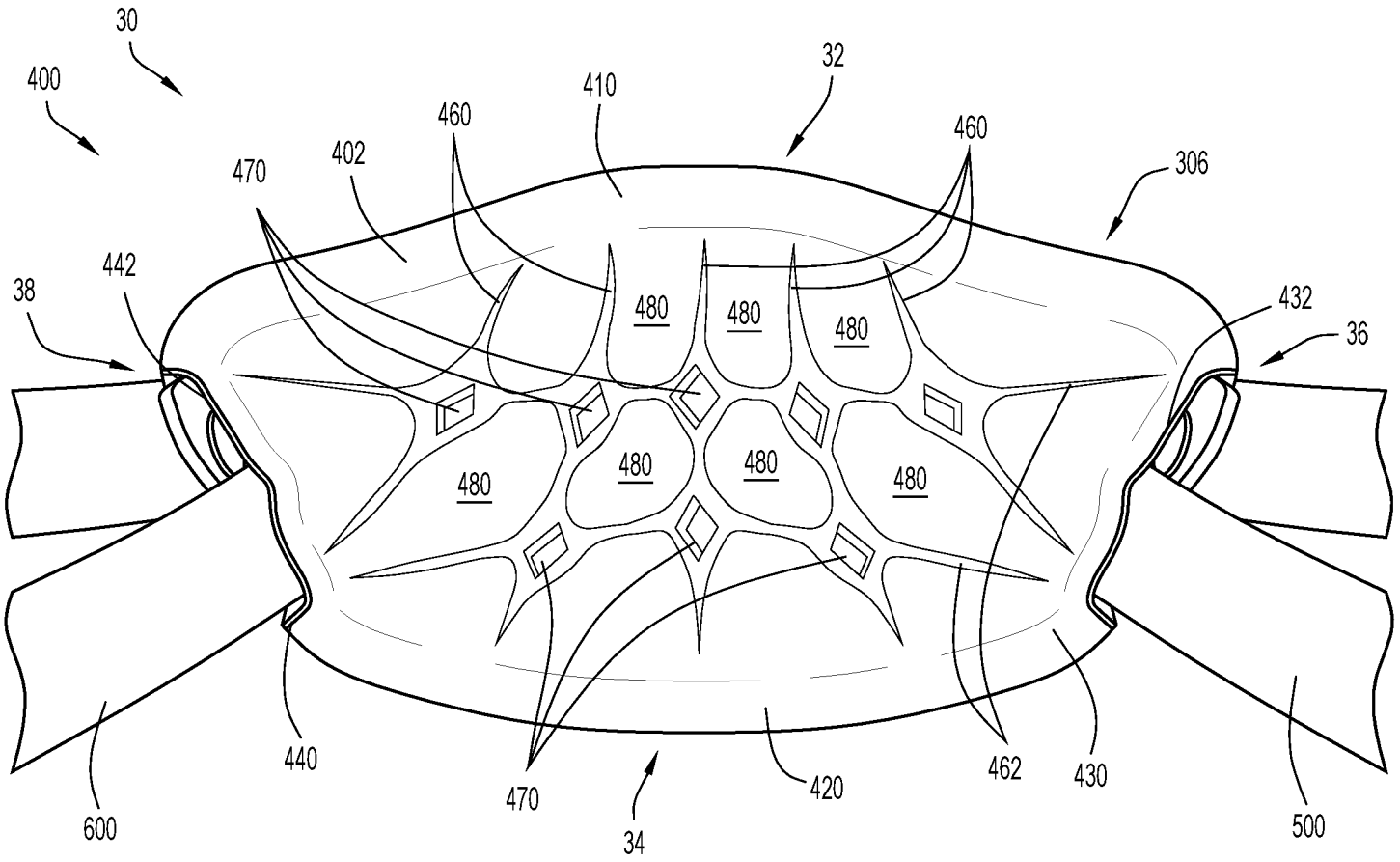
FIG. 9 illustrates a rear view of the embodiment of the chinstrap illustrated in FIG. 7.

Turning to FIG. 9, illustrated is the inner cushion member 400 of the chinstrap 30 disposed within the cavity 306 formed from the cup 300 and configured to follow the curvature of the cup 300. The inner cushion member 400 includes a top 410, a bottom 420, a first side 430, and a second side 440. Similar to the cup 300, the top 410 of the inner cushion member 400 is disposed proximate to the top side 32 of the chinstrap 30, and the bottom 420 of the inner cushion member 400 is disposed proximate to the bottom side 34 of the chinstrap 30. Furthermore, the first side 430 is disposed proximate to the first side 36 of the chinstrap 30, while the second side 440 is disposed proximate to the second side 38 of the chinstrap 30. The inner cushion member 400 further includes a front surface 402 (not illustrated) and a rear surface 404. The front surface 402 of the inner cushion member 400 may be coupled to the rear surface 304 of the cup 300 by conventional means, such as adhesives.

As best illustrated in FIG. 9, the inner cushion member 400 includes a first set of channels 460 disposed in the rear surface 404 of the inner cushion member 400 in the substantially longitudinal direction, the first set of channels 460 extending from the top 410 of the inner cushion member 400 to the bottom 420 of the inner cushion member 400. Moreover, the inner cushion member 400 also includes a second set of channels 462 disposed in the rear surface 404 of the inner cushion member 400 in the substantially lateral direction, the second set of channels 462 extending between the first side 430 and the second side 440 of the inner cushion member 400. In another embodiment of the chinstrap 30, the first set of channels 460 may not fully extend from the top 410 of the inner cushion member 400 to the bottom 420 of the inner cushion member 400, and the second set of channels 462 may not fully extend from the first side 430 and the second side 440 of the inner cushion member 400. The sets of grooves 360, 362 may only extend partially across the front surface 302 of the cup 300. In yet another embodiment, the sets of grooves 360, 362 may be offset from the longitudinal and lateral directions. Similar to the grooves 360, 362 disposed in the cup 300, the first set of channels 460 and the second set of channels 462 also intersect each other to form a grid-like or lattice-like appearance on the rear surface 404 of the inner cushion member 400. The grid-like appearance of the channels 460, 462 creates individual pad sections 480 that are defined by the channels 460, 462. As illustrated, the pad sections 480 may be substantially rectangular. Thus, the pad sections 480 are substantially similar to the cup sections 380 that are disposed on the cup 300. Moreover, located at the intersection of the first set of channels 460 and the second set of channels 462 are apertures 470.

As illustrated in FIG. 9, the apertures 470 of the inner cushion member 400 are in registry with the apertures 370 of the cup 300. It then follows that if the apertures 370, 470 of the cup 300 and the inner cushion member 400 are aligned, then the first set of channels 460 of the inner cushion member 400 are aligned with the first set of grooves 360 in the cup 300, and the second set of channels 462 are aligned with the second set of grooves 460 in the cup 300. Because the apertures 370 on the cup 300 are aligned and thus in registry with the apertures 470 of the inner cushion member 400, the combination of the apertures 370, 470 enables air to flow to the chin received by the chinstrap 30. Providing airflow through the chinstrap 30 enables the chin of the wearer of the chinstrap 30 to maintain a cooler temperature when the chinstrap 30 is in use, which makes the chinstrap 30 more comfortable to wear. The channels 460, 462 being connected with the apertures 470 enables air that flows into the apertures 370 to flow along the channels 460, 462 throughout the surface area covered by the chinstrap 30. Furthermore, the channels 460, 462 are capable of collecting sweat from the chin of the wearer and divert the sweat from the area of the chin that is covered by the chinstrap 30.

By aligning the first set of channels 460, second set of channels 462, apertures 470, and pad sections 480 with the first set of grooves 360, second set of grooves 362, apertures 370, and cup sections 380, respectively, the inner cushion member 400 is operable to flex as the cup 300 flexes. The ability of the inner cushion member 400 to flex with the cup 300 combined with the inner cushion member 400 being constructed from a substantially compressible material increases the comfort of the chinstrap 30 for the wearer. The alignment of the apertures 370 on the cup 300 with the apertures 470 of the inner cushion member 400 further increases the comfort of the chinstrap 30 by enabling air to flow to the chin of the wearer of the chinstrap 30. The inner cushion member 400 may flex in the same manner and to a similar degree as the cup 300. Because the inner cushion member 400 is constructed from a compressible material, the inner cushion member 400 would still be able to flex and bend with the cup 300 if the inner cushion member 400 did not contain the channels 460, 462, but the channels 460, 462 prevent the inner cushion member 400 from bending and folding onto itself.

Figure 7:
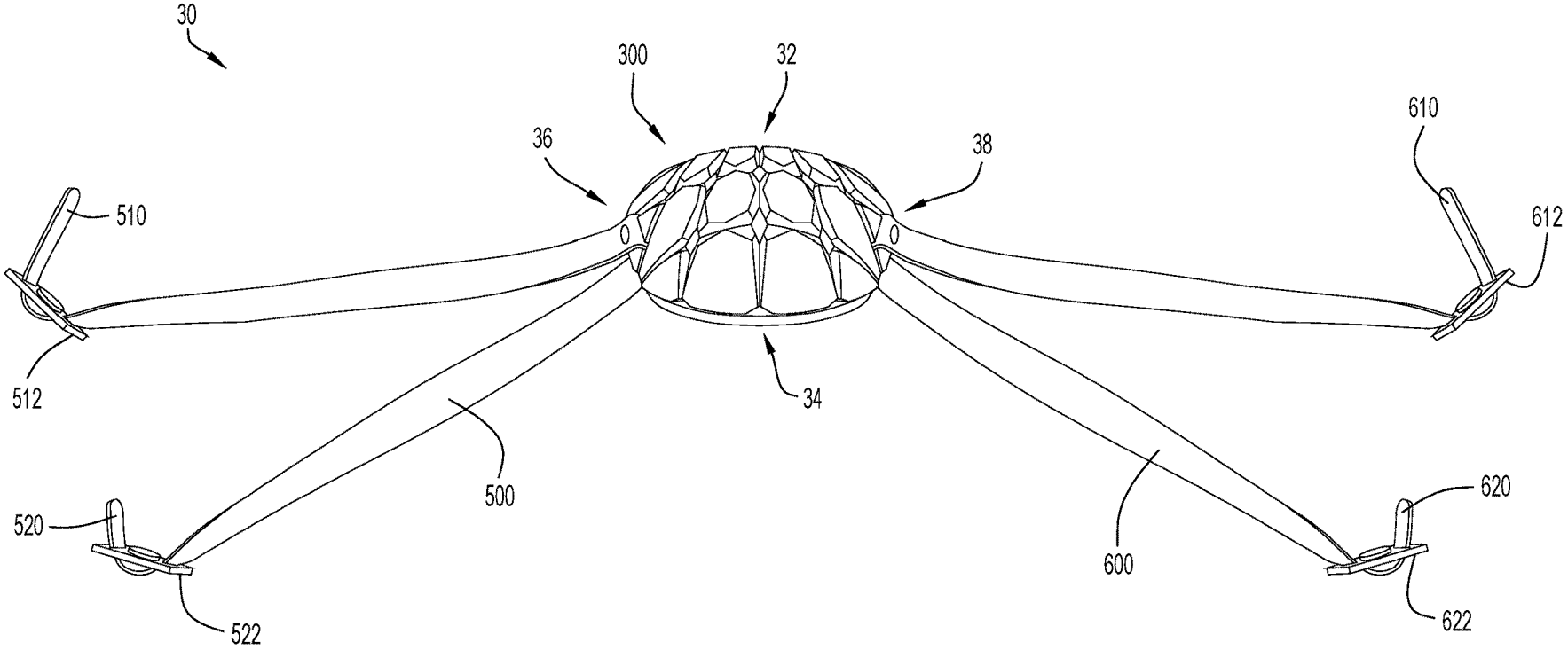
FIG. 7 illustrates a front view of an embodiment of a chinstrap according to the present invention.

As previously explained, the chinstrap 30 includes a first strap 500 and a second strap 600. The first and second straps 500, 600 are best illustrated in FIGS. 7-10. The first strap 500 extends from the third side 36 of the chinstrap 30, while the second strap 600 extends from the fourth side 38 of the chinstrap 30. The first and second straps 500, 600 enable the chinstrap 30 to be connected to a helmet, such as a football helmet. As illustrated in FIG. 7, the first strap 500 includes a first end 510 and a second end 520 opposite the first end 510. The ends 510, 520 of the first strap 500 are disposed away from the first end 36 of the chinstrap 30. Moreover, disposed proximate to the first end 510 is a buckle 512, while another buckle 522 is disposed proximate to the second end 520. These buckles 512, 522 are configured to couple the strap 500, and ultimately the chinstrap 30, to a helmet. Moreover, the buckles 512, 522 are adjustable along the length of the strap 500.

Similarly, the second strap 600 includes a first end 610 and a second end 620 opposite the first end 610. The ends 610, 620 of the second strap 600 are disposed away from the second end 38 of the chinstrap 30. The second strap 600 also includes two buckles 612, 622, where one buckle 612 is disposed proximate to the first end 610 and the other buckle 622 is disposed proximate to the second end 620. Similar to the buckles 512, 522 of the first strap 500, the buckles 612, 622 of the second strap 600 are adjustable along the length of the strap 600 and are configured to couple the strap 600, and ultimately the chinstrap 30, to a helmet. The buckles 512, 522, 612, 622 may each contain a snap button that enables them to be coupled to a helmet.

Figure 10:
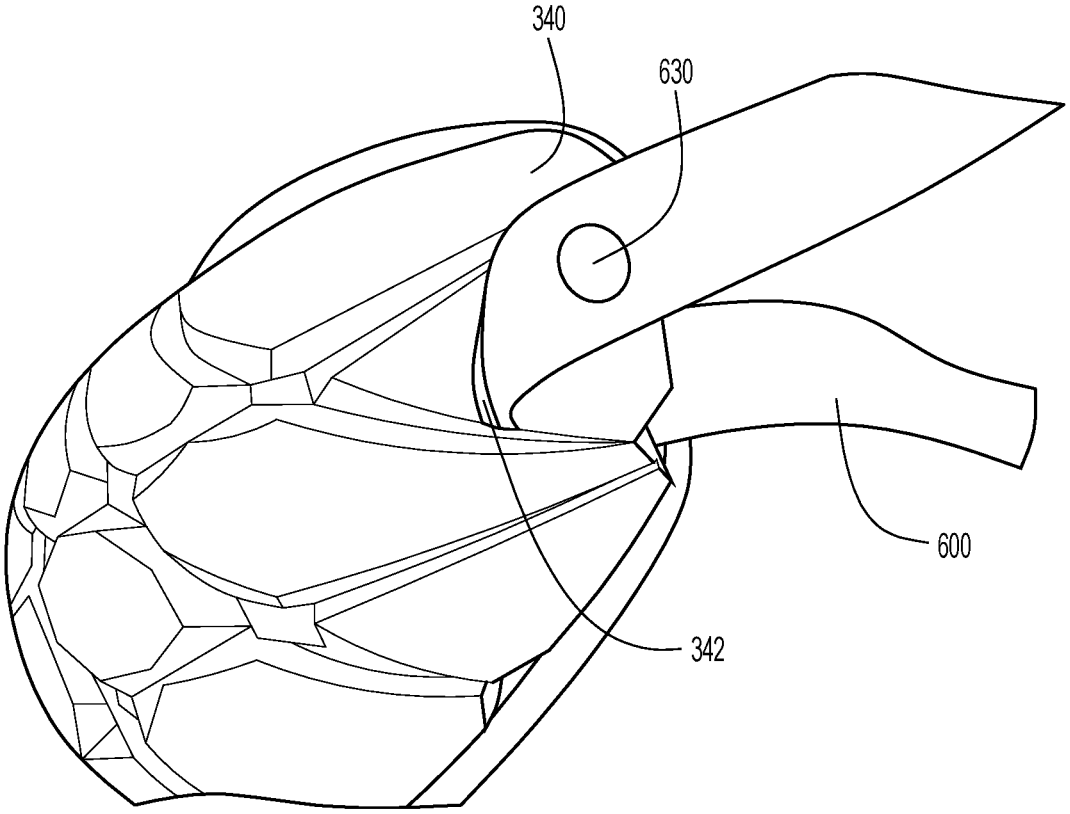
FIG. 10 illustrates a side view of the plate of the embodiment of the chinstrap illustrated in FIG. 7.

Referring to FIGS. 8 and 10, disposed in the cup 300 proximate to the third side 330 is a first slot 332. In addition, a second slot 342 is disposed in the cup 300 proximate to the fourth side 340. While FIG. 10 only illustrates the fourth side 340 of the cup 300 of the chinstrap 30, the illustration of the fourth side 340 applies to the third side 330 because the third side 330 is identical, but mirrored, to the fourth side 340. As further illustrated in FIGS. 8 and 10, the first strap 500 is threaded through the first slot 332 and the second strap 600 is threaded through the second slot 342. The first strap 500 is held in place in the first slot 332 by a fastener 530. Similarly, and as best illustrated in FIG. 10, the second strap 600 is held in place in the second slot 342 by a fastener 630. In other embodiments, the first and second straps 500, 600 may not include fasteners 530, 630, and may be configured to slide freely through the first and second slots 332, 342.

Referring again to FIG. 9, disposed in the inner cushion member 400 proximate to the third side 430 is a first recess 432, while a second recess 442 is disposed in the inner cushion member 400 proximate to the fourth side 440. The first recess 432 and the second recess 442 are disposed against the cup 300, such that the first and second recesses 432, 442 in conjunction with the cup 300 form a pair of slots. As illustrated in FIG. 9, the first strap 500 extends out of the first recess 432, while the second strap 600 extends out of the second recess 442. Once the first strap 500 is threaded through the first slot 332 of the cup 300, a portion of the first strap 500 is configured to be partially disposed between the rear surface 304 of the cup 300 and the front surface 402 of the inner cushion member 400, while another portion of the first strap 500 extends out from the first recess 432. Similarly, once the second strap 600 is threaded through the second slot 342 of the cup 300, a portion of the second strap 600 is partially disposed between the rear surface 304 of the cup 300 and the front surface 402 of the inner cushion member 400, while another portion of the second strap 600 extends out from the second recess 442.

Figure 11:
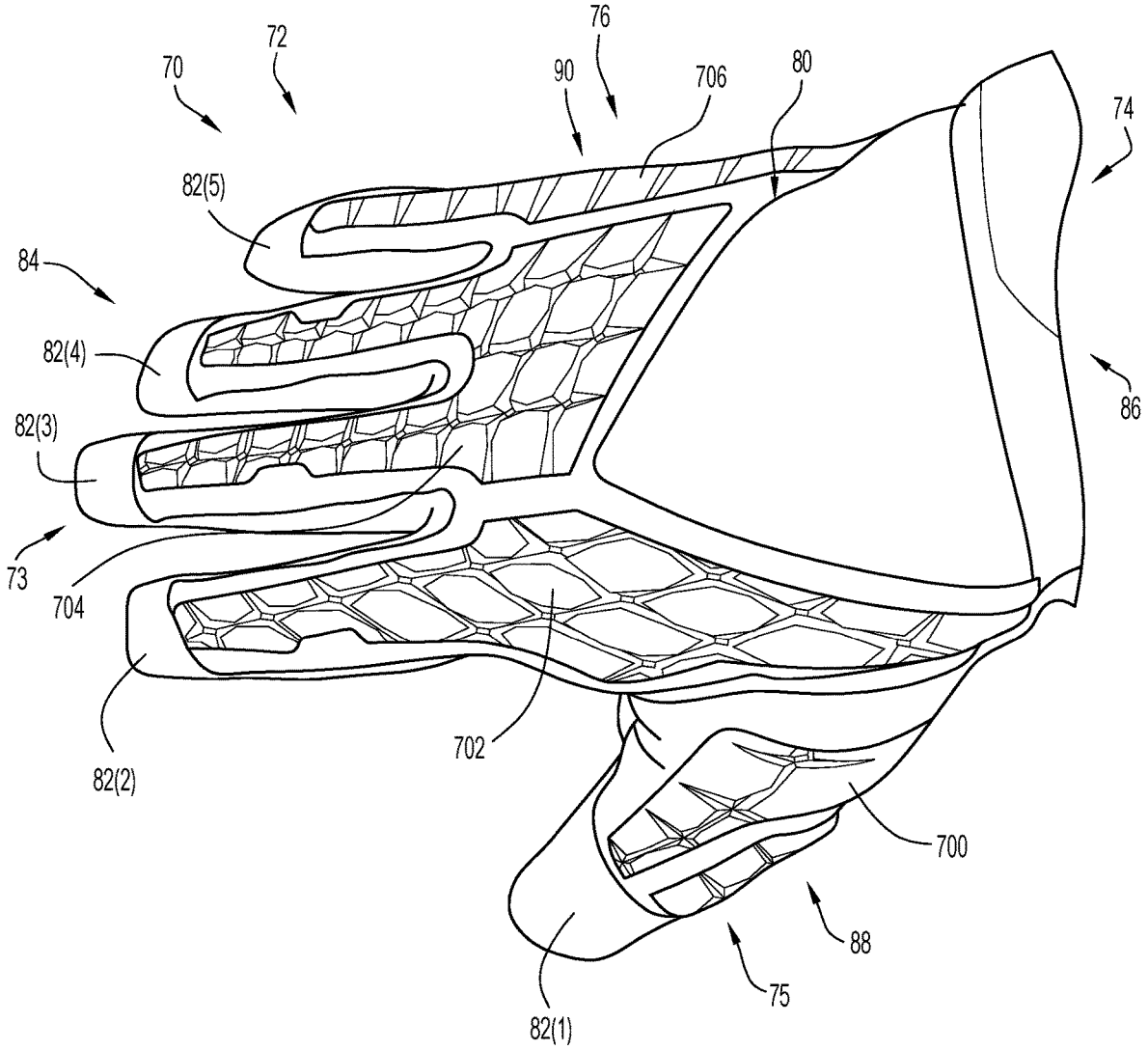
FIG. 11 illustrates a top view of an embodiment of a glove according to the present invention.
Figure 12:
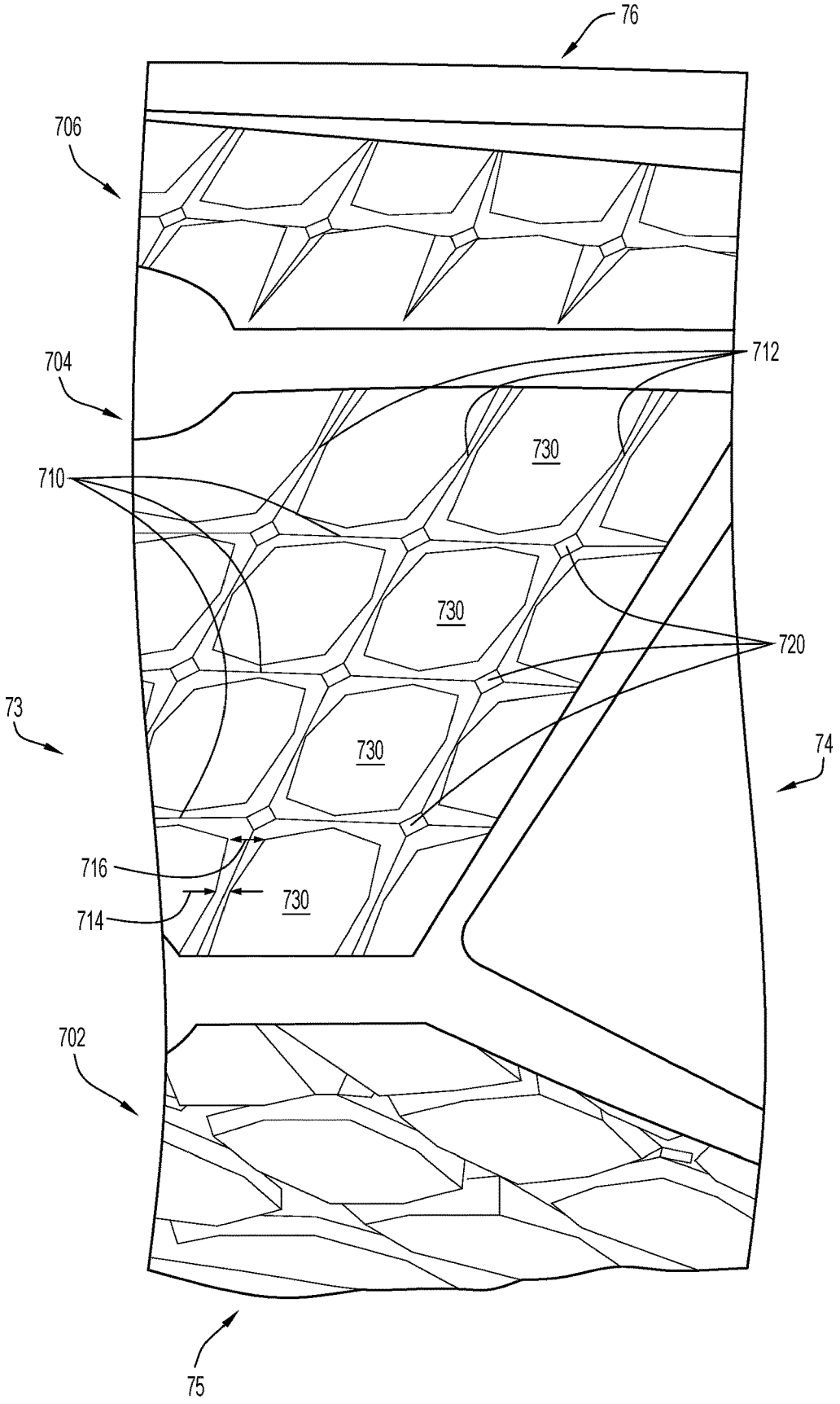
FIG. 12 illustrates a detailed view of a padded region of the glove illustrated in FIG. 11.

Another apparatus that implements a flexure system in accordance with the present invention is depicted in FIGS. 11 and 12 in the form of a glove 70. The glove 70 includes a series of grooves and apertures, similar to that of the shin guard 10 and the chinstrap 30. The glove 70 includes a palm side 71 (not shown) and a dorsal side 72. The glove 70 also includes a first side 73, a second side 74, a third side 75, and a fourth side 76. The glove 70 further includes a metacarpal region 80 with a top end 84, a bottom or wrist end 86, a first end 88, and a second end 90. The wrist end 86 is disposed opposite of the top end 84, where the wrist end 86 is disposed proximate to the second side 74 of the glove 70 and the top end 84 is disposed proximate to the first side 73 of the glove 70. The second end 90 is disposed opposite of the first end 88, where the first end 88 is disposed proximate to the third side 75 of the glove 70 and the second end 90 is disposed proximate to the fourth side 76 of the glove 70. Moreover, extending from the first end 88 of the metacarpal region 80 is a thumb sheath 82(1), and extending from the top end 84 of the metacarpal region 80 are four additional fingers sheathes 82(2)-82(5). The glove 70 may be constructed from a four-way stretch fabric material 77 that is configured to bend and contour to a user's hand as the user uses their hands to interact with their environment.

As further illustrated in FIG. 11, the glove 70 also includes four padded regions 700, 702, 704, 706 disposed on the dorsal side 74 of the glove 70. The first padded region 700 is disposed on the first finger/thumb 82(1). The second padded region 702 is disposed partially on the metacarpal region 80 proximate to the first end 88, and configured to extend along the second finger 82(2). The third padded region 704 is at least partially disposed on the metacarpal region 80 between the first and second ends 88, 90, and is configured to extend along both the third and fourth fingers 82(3), 82(4). Finally, the fourth padded region 706 is at least partially disposed on the metacarpal region 80 proximate to the second end 90, and is configured to extend along the fifth finger 82(5). The padded regions 700, 702, 704, 706 may be constructed from a durable and resilient material that provides impact protection to the hand on which the glove 70 is disposed, such as a thermoplastic rubber. The padded regions 700, 702, 704, 706 may have a higher durometer value than that of the fabric material 77. The padded regions 700, 702, 704, 706 may be directly injected into the fabric layer 77 to adhere the padded regions 700, 702, 704, 706 to the fabric layer 77.

FIG. 12 illustrates a detailed view of the third padded region 704. While only the third padded region 704 may be discussed, the discussion of FIG. 12 applies to first, second, and fourth padded regions 700, 702, 706, as these padded regions 700, 702, 706 contain the same features of the third padded region 704. As illustrated in FIG. 12, disposed within the third padded region 704 are a first set of grooves 710 and a second set of grooves 712. The first set of grooves 710 extend substantially from the first side 73 to the bottom side 74. The second set of grooves 712 extend substantially from the third side 75 to the fourth side 76. Similar to the shin guard 10 and the chinstrap 30, the sets of grooves 710, 712 of the gloves 70 are configured to intersect one another and form a grid-like or lattice appearance. At the intersection of the first set of grooves 710 with the second set of grooves 712 are apertures 720. Moreover, the grid-like appearance of the grooves 710, 712 define a plurality of outer pad sections 730 that are substantially rhomboidal.

As further illustrated in FIG. 12, the grooves 710, 712 are formed as depressions in the padded regions 700, 702, 704, 706. The grooves 710, 712 may be formed on the padded regions 700, 702, 704, 706 utilizing any suitable process including, without limitation, etching, engraving, carving, impressing, scoring, incising, stamping, defined during formation of the component (e.g., formed in a molding process), etc. Moreover, the grooves 710, 712 of the padded regions 700, 702, 704, 706 of the glove 70 may vary in width, similar to that of the grooves 160, 162 of the shin guard 10 and the grooves 360, 362 of the chinstrap 30. The grooves 710, 712 may vary between a first width 714 and a second width 716. The first width 714 may be the minimum, or smallest, width of the grooves 710, 712, while the second width 716 may be the maximum, or largest, width of the grooves 710, 712. The grooves 710, 712 may have the second width 716 at points of the grooves 710, 712 that are proximate to the apertures 720. Furthermore, the grooves 710, 712 may have the first width 714 at points of the grooves 710, 712 that are disposed farthest from the apertures 720. Thus, the grooves 710, 712 may have the first width 714 at a point between, and equidistant from, two apertures 720. The width of grooves 710, 712 may gradually increase or decrease between the first width 714 and the second width 716.

The varying widths 714, 716 of the grooves 710, 712 define beveled edges along the sides of each of the pad sections 730, where each side of a padded section has a generally convex shape that corresponds with a generally convex side of an adjacent or neighboring pad section (where the corresponding sides of the adjacent or neighboring pad sections are defined within the same groove 710, 712). The configuration of the pad sections 730 provide as much coverage as possible over the padded region while flexure of the padded region is enhanced by the grooves 710, 712.

The combination of the grooves 710, 712 and the apertures 720 enable the padded regions 700, 702, 704, 706 to flex and conform to the hand during palmarflexion and dorsiflexion of the hand, flexion and extension of the fingers of the hand, and abduction and adduction of the fingers of the hand. Thus, while the hand wearing the glove 70 performs various gestures (e.g., makes a fist, or catches a ball, etc.), the combination of the grooves 710, 712 and the apertures 720 enable the padded regions 700, 702, 704, 706 of the glove 70 continue to provide impact protection to the hand. The grooves 710, 712 define the lines of flexure of the padded regions 700, 702, 704, 706. Moreover, the padded regions 700, 702, 704, 706 are capable of flexing along each of the grooves 710, 712, enabling each of the pad sections 730 to move a varying degree. In addition, because the padded regions 700, 702, 704, 706 are constructed from a thermoplastic rubber, the padded regions 700, 702, 704, 706 are able to stretch with the fabric 77 of the glove 70. The grooves 710, 712 and the apertures 720 enable the padded regions 700, 702, 704, 706 of the glove 70 to continue to provide impact protection while still enabling mobility of the hand within the glove 70.

Another embodiment of an apparatus incorporating a flexure system in accordance with the present invention is described with reference to FIGS. 13-16. In particular, a sleeve 800 includes a series of padded regions having grooves and apertures, similar to that of the glove 70. The sleeve 800 may be worn by a user on their extremities, such as over the forearm, over the elbow, over the upper arm, etc. and/or for another limb (e.g., different portions of the user's leg). The sleeve 800 is substantially tubular with a first end 801 and a second end 802. The diameter or transverse cross-section of the sleeve 800 may taper from the first end 801 to the second end 802 to accommodate the shape of an arm that is larger in diameter proximate the shoulder and smaller in diameter proximate the hand. The sleeve 800 may be constructed from a four-way stretch fabric material 810 that is configured to bend and contour to a user's arm, especially during movement of the arm. The four-way stretch fabric material 810 further provides compression of the extremity on which the sleeve 800 is disposed. The sleeve 800 has an outer surface 812 (best illustrated in FIG. 13) and an outer surface 814 (best illustrated in FIG. 16). Disposed on the sleeve 800 between the first end 801 and the second end 802 are padded regions 820, 822, 824, 826. The padded regions 820, 822, 824, 826 may be constructed from a durable resilient material that provides impact protection, such as a thermoplastic rubber (e.g., a thermoplastic elastomer). The padded regions 820, 822, 824, 826 may have a higher durometer value than that of the fabric material 810 of the sleeve. In addition, the padded regions 820, 822, 824, 826 may be disposed on the outer surface 812 of the fabric material 810 of the sleeve 800 by being injection molded (or applied in any other suitable manner) directly on the fabric material 810.

Figure 13:
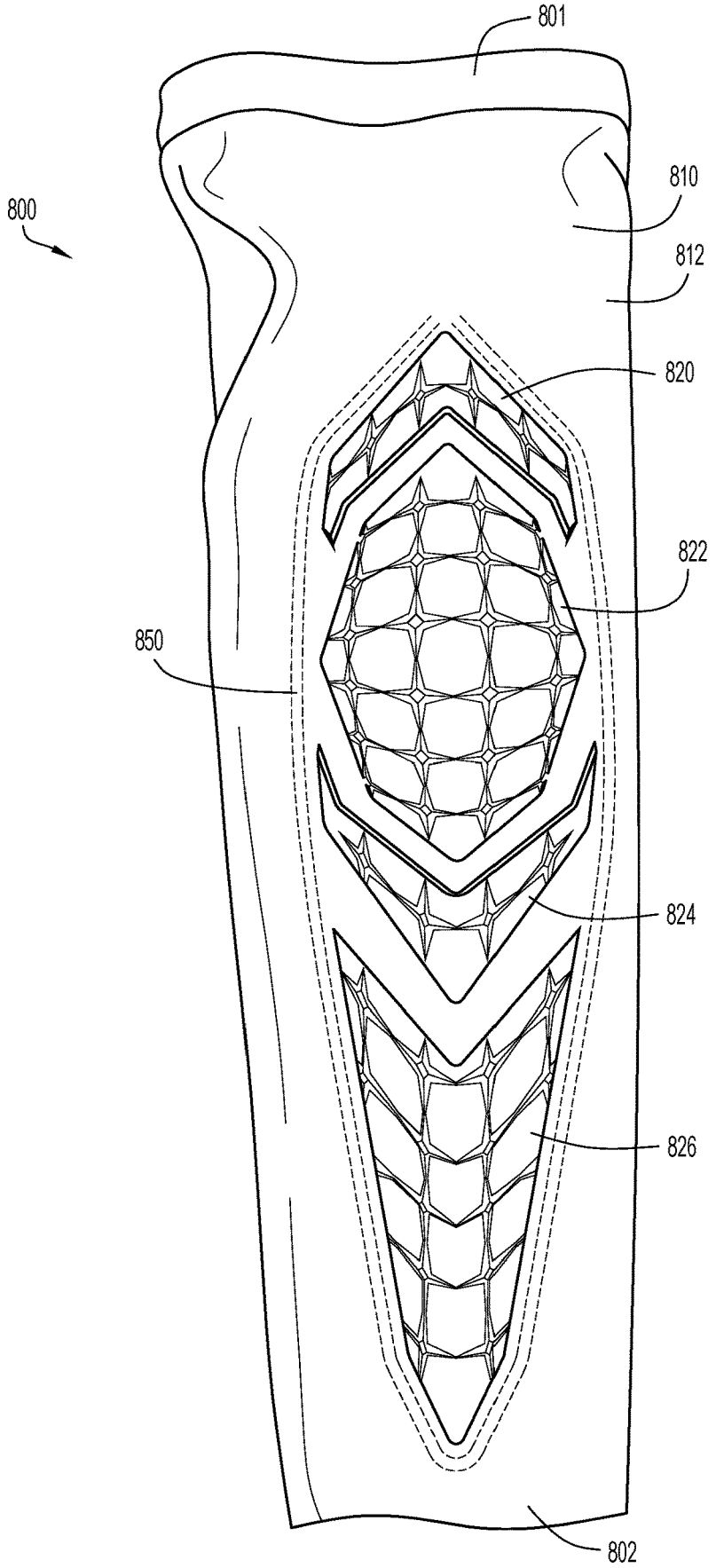
FIG. 13 illustrates a top view of an embodiment of a sleeve according to the present invention.
Figure 14:
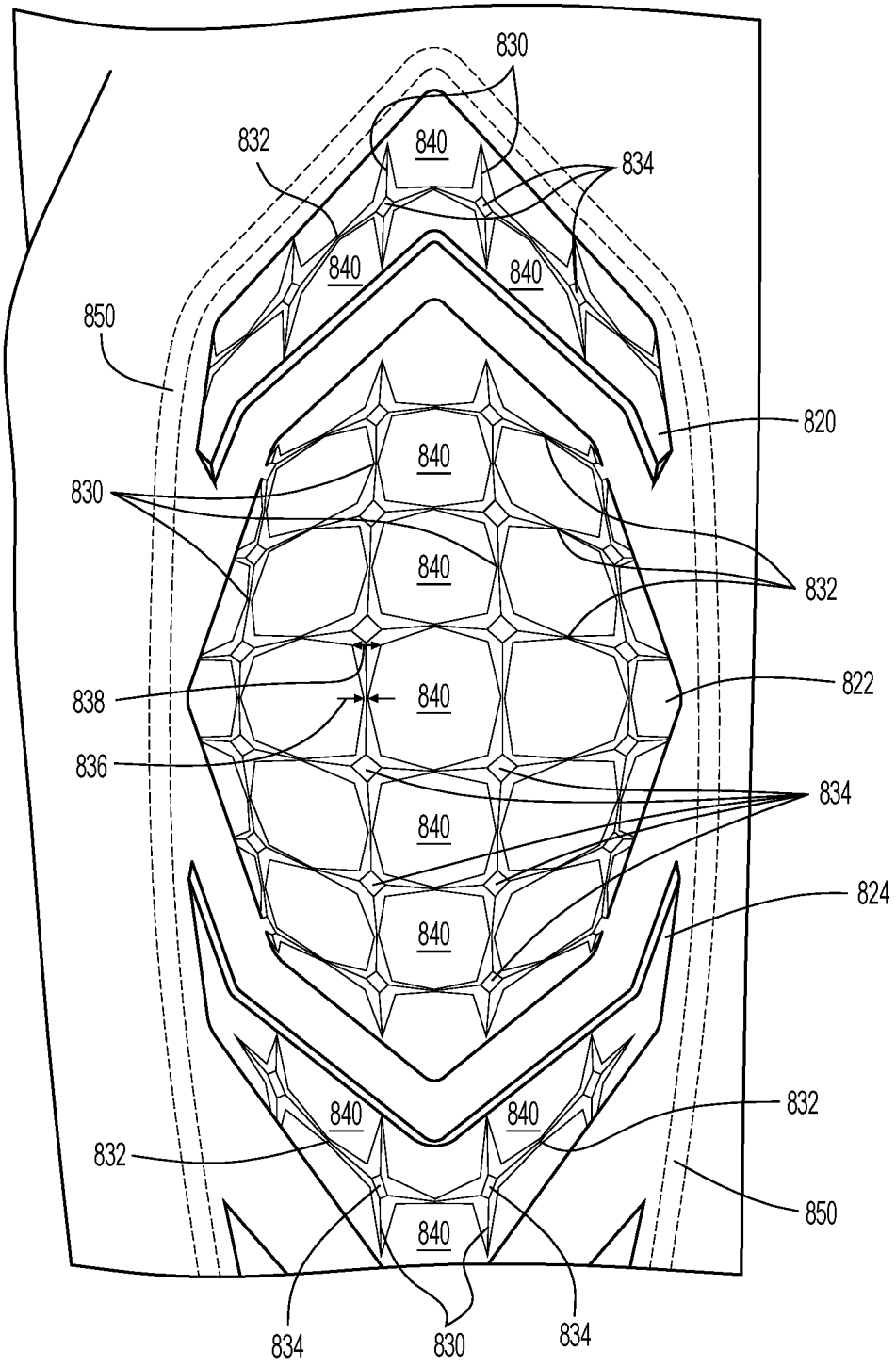
FIG. 14 illustrates a first detailed view of a portion of a padded region of the sleeve illustrated in FIG. 13.
Figure 15:
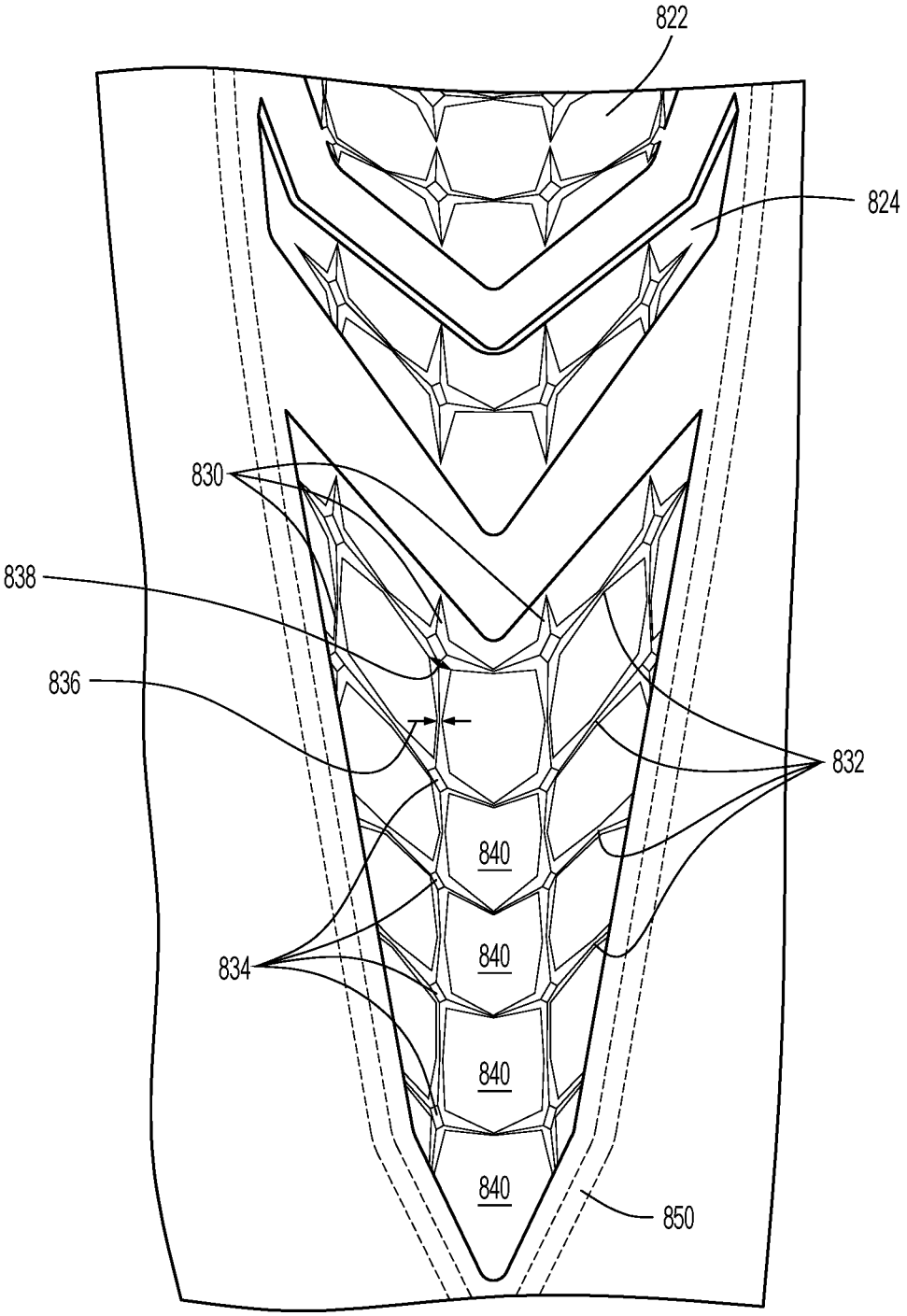
FIG. 15 illustrates a second detailed view of another portion of the padded region of the sleeve illustrated in FIG. 13.

As further illustrated in FIGS. 14 and 15, the padded regions 820, 822, 824, 826 may be constructed in different shapes, different sizes, and are separated by the four-way stretchable fabric material 810. By having four separate padded regions 820, 822, 824, 826 that are separated by the fabric material 810, the sleeve 800 is able to provide sufficient impact protection for the area spanning from the padded region 820 to padded region 826 with a minimal amount of thermoplastic rubber. Having the padded regions 820, 822, 824, 826 separated as shown in FIGS. 13-15 serves multiple purposes. Firstly, it allows the area covered by the padded regions 820, 822, 824, 826 to flex and bend with the movement and bending of the extremity on which the sleeve 800 is disposed. Secondly, the separation of the padded regions 820, 822, 824, 826 minimizes the amount of thermoplastic rubber that is used to provide impact protection, which reduces the weight of the sleeve 800. This enables the sleeve 800 to be more comfortable to wear without reducing the performance capabilities of the sleeve 800 and without impacting the performance capabilities of the wearer. Thirdly, using the minimum amount of thermoplastic rubber reduces the manufacturing costs of the sleeve 800.

In addition to each of the padded regions 820, 822, 824, 826 being separated by the four-way stretch fabric 810, each of the padded regions 820, 822, 824, 826 may contain a first set of grooves 830 and a second set of grooves 832 that further enable each of the padded regions 820, 822, 824, 826 to flex, bend, and contour while providing sufficient impact protection. The first set of grooves 830 extend along the length (from the first end 801 to the second end 802) of the sleeve 800, while the second set of grooves 832 span substantially along the width of the sleeve 800. Similar to the shin guard 10, the chinstrap 30, and the glove 70, the sets of grooves 830, 832 of the sleeve 800 are configured to intersect one another and form a grid-like or lattice appearance on each padded regions 820, 822, 824, 826. At the intersection of the first set of grooves 830 with the second set of grooves 832 are apertures 834.

The grid-like appearance of the grooves 830, 832, moreover, define a plurality of outer pad sections 840 that are substantially rhomboidal. The grooves 830, 832 are formed as depressions in the padded regions 820, 822, 824, 826. The grooves 830, 832 may be formed on the padded regions 820, 822, 824, 826 via any suitable process including, without limitation, etching, engraving, carving, impressing, scoring, incising, stamping, defined during formation of the component (e.g., formed in a molding process), etc. Thus, the pad sections 840 may be thicker than the grooves 830, 832. In other words, more material is disposed on the outer surface 812 of the fabric material 810 at the pad sections 840 than at the grooves 830, 832. Furthermore, the grooves 830, 832 of the padded regions 820, 822, 824, 826 of the sleeve 800 may vary in width, similar to that of the grooves 160, 162 of the shin guard 10, the grooves 360, 362 of the chinstrap 30, and grooves 710, 712 of the glove 70. The grooves 830, 832 may vary between a first width 836 and a second width 838. The first width 836 may be the minimum, or smallest, width of the grooves 830, 832, while the second width 838 may be the maximum, or largest, width of the grooves 830, 832. The grooves 830, 832 may have the second width 838 at points of the grooves 830, 832 that are proximate to the apertures 834. Furthermore, the grooves 830, 832 may have the first width 836 at points of the grooves 830, 832 that are disposed farthest from the apertures 834. Thus, the grooves 830, 832 may have the first width 836 at a point between, and equidistant from, two apertures 834. The width of grooves 830, 832 may gradually increase or decrease between the first width 836 and the second width 834.

The varying widths 836, 838 of the grooves 830, 832 define beveled edges along the sides of each of the pad sections 840, where each side of a pad section has a generally convex shape that corresponds with a generally convex side of an adjacent or neighboring pad section (where the corresponding sides of the adjacent or neighboring pad sections are defined within the same groove 830, 832). The configuration of the pad sections 840 provide as much coverage as possible over the padded region while flexure of the padded region is enhanced by the grooves 830, 832.

The combination of the separation of the padded regions 820, 822, 824, 826 by the four-way stretch fabric material 810, the grooves 830, 832, and the apertures 834 enable the padded regions 820, 822, 824, 826 to flex and conform to the extremity on which the sleeve 800 is disposed. The grooves

830, 832 define the lines of flexure of each of the padded regions 820, 822, 824, 826, while the separation of the padded regions 820, 822, 824, 826 enable further flexure of the sleeve 800 in the area containing the padded regions 820, 822, 824, 826. Moreover, the padded regions 820, 822, 824, 826 are capable of flexing along each of the grooves 830, 832, enabling each of the padded regions 820, 822, 824, 826 to move a varying degree. In addition, each of the padded regions 820, 822, 824, 826, because they are constructed from a thermoplastic rubber, are able to stretch with the fabric material 810 of the sleeve 800. The separation of the padded regions 820, 822, 824, 826, grooves 830, 832, and the apertures 834 enable the padded regions 820, 822, 824, 826 of the sleeve 800 to continue to provide impact protection while still enabling mobility of the extremity on which the sleeve 800 is disposed. For example, if the sleeve 800 were disposed on a user's arm such that the padded regions 820, 822, 824, 826 are disposed over and around the elbow of the user's arm, the padded regions 820, 822, 824, 826 would flex and contour to the elbow of the user as the user bends their arm. In addition, because both the fabric material 810 and the padded regions 820, 822, 824, 826 are stretchable, the sleeve 800 is configured to tightly wrap around and contour to the wearer's extremity without being uncomfortable to wear.

Figure 16:
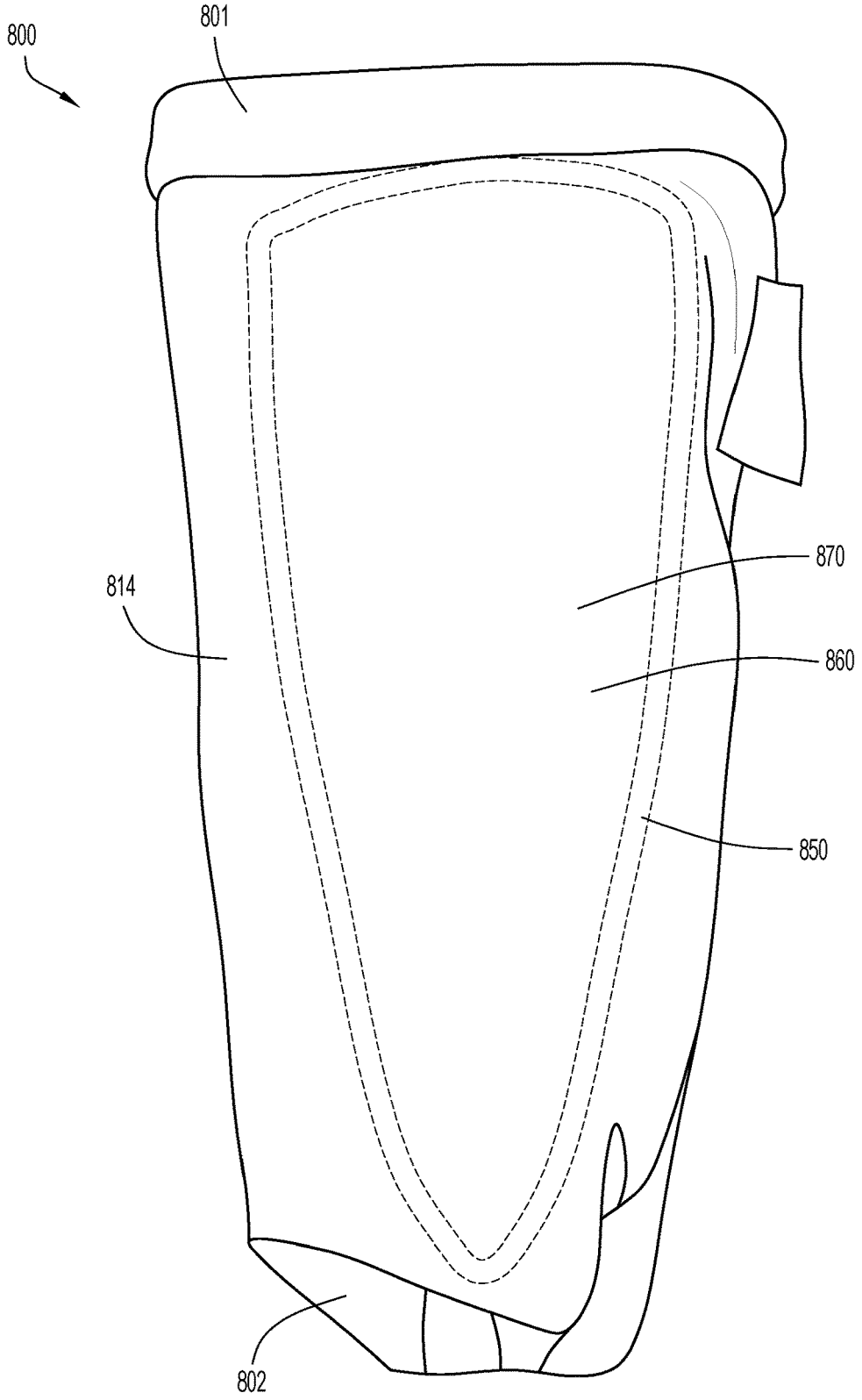
FIG. 16 illustrates a view of the interior of the sleeve illustrated in FIG. 13.

As illustrated in FIGS. 14-16, disposed around the padded regions 820, 822, 824, 826 is a seam 850. As best illustrated in FIG. 16, the seam 850 defines a pocket 860 on the inner surface 814 of the fabric material 10. The pocket 860 may be disposed on the inner surface 814 of the fabric material 10 via other means than a seam, such as glue, cement, etc. Disposed within the pocket 860 is a pad 870 that may be constructed from a soft compressible material, such as ethylene-vinyl acetate (EVA) foam. Thus, the pad 870 is configured to bend and compress, and has a lower durometer than that of the padded regions 820, 822, 824, 826. Because the pad 870 is disposed within the pocket 860, and because the pocket is in registry with the padded regions 820, 822, 824, 826, the pad 870 is disposed proximate the portion of the extremity that is to be provided with impact protection by the sleeve 800. Therefore, the sleeve 800 is configured to provide impact protection spanning from the padded region 820 to the padded region 826 via the padded regions 820, 822, 824, 826, the four-way stretch fabric material 810, and the pad 870. In addition, the pad 870 may be able to slide within the pocket 860. This sliding ability of the pad 870 enables the sleeve 800 to remain in place on the extremity as the extremity moves and bends.

The description and methods of the shin guard 10, the chinstrap 30, the glove 70, and the sleeve 800 as described herein may be applied to any other type of protective gear used in other sports or other situations, such as, but not limited to catcher's leg guards, catcher's chest protector, baseball helmets, a football helmets, football pads, hockey pads, hockey helmets, wrist guards, bullet proof vests, etc.

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. A chinstrap configured to be worn by a user during a sport activity, the chinstrap including a flexure system, wherein the flexure system comprises:

a support structure including a plurality of intersecting grooves disposed along a surface of the support structure;

wherein a plurality of segments are defined along the surface of the support structure between the plurality of intersecting grooves such that the support structure is configured to flex along the plurality of intersecting grooves with at least one segment of the plurality of segments moving in relation to other segments of the plurality of segments; and at least two sides of adjacent segments that are defined by a same groove are each convex in shape so as to interact with each other and limit a degree of flexure of the support structure when the two sides of the adjacent segments are moved toward each other.

2. The chinstrap of claim 1, wherein at least one groove of the plurality of intersecting grooves has a geometry in which a width continuously varies along a length of the at least one groove between a maximum width of the at least one groove and a minimum width of the at least one groove, the maximum width of the at least one groove being disposed proximate to intersections with other grooves of the plurality of intersecting grooves, and the minimum width of the at least one groove being spaced from the intersections with the other grooves of the plurality of intersecting grooves.

3. The chinstrap of claim 1, further comprising a plurality of apertures disposed on the surface of and extending through the support structure, wherein each aperture is located at an intersection of two grooves of the plurality of intersecting grooves.

4. The chinstrap of claim 1, wherein the plurality of intersecting grooves comprise a first set of grooves extending substantially in a longitudinal direction of the support structure and a second set of grooves extending in a direction transverse the longitudinal direction of the support structure.

5. The chinstrap of claim 1, wherein each side of each segment has a convex shape that aligns with a convex shape of a corresponding side of an adjacent segment defined by a same groove that separates each segment from each adjacent segment.

6. A chinstrap configured to be worn by a user during a sport activity, the chinstrap comprising:

a cup including an outer surface and an inner surface;

at least one first groove disposed and oriented in a first direction along the outer surface of the cup;

at least one second groove disposed and oriented in a second direction along the outer surface of the cup, the at least one second groove intersecting the at least one first groove, wherein the cup is configured to flex along the at least one first groove and the at least one second groove; and a compressible cushion member disposed on the inner surface of the cup, wherein the compressible cushion member includes at least one first channel disposed and oriented in a first direction along a user facing surface of the cushion member, and at least one second channel disposed and oriented in a second direction along the user facing surface of the cushion member.

7. The chinstrap of claim 6, wherein a plurality of segments are defined along the outer surface of the cup between the intersection of the at least one first groove with the at least one second groove, and when the cup flexes along the at least one first groove and the at least one second groove, at least one first segment of the plurality of segments moves in relation to at least one second segment of the plurality of segments.

8. The chinstrap of claim 6, further comprising at least one aperture disposed on the cup such that the at least one aperture extends through the cup from the outer surface to the inner surface, wherein the at least one aperture is located at an intersection of the at least one first groove with the at least one second groove.

9. The chinstrap of claim 6, wherein the cushion member includes at least one opening extending through the cushion member, wherein the at least one opening is located at an intersection of the at least one first channel with the at least one second channel, and aligns with the at least one aperture of the cup.

10. The chinstrap of claim 6, wherein the cup further includes a first slot disposed proximate to a first side of the cup, and a second slot disposed proximate to a second side of the cup, the first slot and the second slots extend through the cup from the outer surface to the inner surface.

11. The chinstrap of claim 10, further comprising a first strap threaded through the first slot, and a second strap threaded through the second slot.

12. The chinstrap of claim 11, wherein a portion of the first strap extends between the cushion member and the inner surface of the cup, and a portion of the second strap extends between the cushion member and the inner surface of the cup.

13. A chinstrap configured to be worn by a user during a sport activity, the chinstrap comprising:

a cup configured to at least partially receive a chin of a user;

a plurality of channels disposed on the cup, wherein the cup is configured to flex along the plurality of channels, wherein the plurality of channels comprise:

a plurality of first channels oriented in a first direction along the cup; and a plurality of second channels oriented in a second direction along the cup such that the plurality of second channels intersect the plurality of first channels; and at least one channel of the plurality of first channels or the plurality of second channels has a geometry in which a width of the at least one channel continuously varies along a length of the at least one channel between a maximum width of the at least one channel and a minimum width of the at least one channel, the maximum width of the at least one channel being disposed proximate to at least one intersection of the plurality of first channels with the plurality of second channels, and the minimum width of the at least one channel being spaced from the at least one intersection.

14. The chinstrap of claim 13, wherein a plurality of segments are defined along the cup between the at least one intersection of the plurality of first channels with the plurality of second channels, and when the cup flexes along the plurality of first channels and the plurality of second channels, at least one first segment of the plurality of segments moves in relation to at least one second segment of the plurality of segments.

15. The chinstrap of claim 13, further comprising at least one aperture disposed on the cup, wherein the at least one aperture is located at the at least one intersection of the plurality of first channels with the plurality of second channels.

16. The chinstrap of claim 15, further comprising a compressible backing member disposed on a user facing side of the cup, the backing member including at least one first groove disposed and oriented in a first direction along a user facing surface of the backing member, at least one second groove disposed and oriented in a second direction along the user facing surface of the backing member, and at least one opening extending through the backing member, wherein the at least one opening is located at an intersection of the at least one first groove with the at least one second groove, and being aligned with the at least one aperture of the cup.

17. A chinstrap configured to be worn by a user during a sport activity, the chinstrap including a flexure system, wherein the flexure system comprises:

a support structure including a plurality of intersecting grooves disposed along a surface of the support structure;

wherein a plurality of segments are defined along the surface of the support structure between the plurality of intersecting grooves such that the support structure is configured to flex along the plurality of intersecting grooves with at least one segment of the plurality of segments moving in relation to other segments of the plurality of segments; and at least one groove of the plurality of intersecting grooves has a geometry in which a width continuously varies along a length of the at least one groove between a maximum width of the at least one groove and a minimum width of the at least one groove, the maximum width of the at least one groove being disposed proximate to intersections with other grooves of the plurality of intersecting grooves, and the minimum width of the at least one groove being spaced from the intersections with the other grooves of the plurality of intersecting grooves.

* * * * *